US008567003B2

(12) United States Patent
McLeod et al.

(10) Patent No.: US 8,567,003 B2
(45) Date of Patent: Oct. 29, 2013

(54) VACUUM CLEANING APPLIANCE

(75) Inventors: David Andrew McLeod, Malmesbury (GB); Matthew John Dobson, Malmesbury (GB); Spencer James Robert Arthey, Malmesbury (GB); Charles Gareth Owen, Malmesbury (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 384 days.

(21) Appl. No.: 13/032,366

(22) Filed: Feb. 22, 2011

(65) Prior Publication Data

US 2011/0214249 A1 Sep. 8, 2011

(30) Foreign Application Priority Data

Mar. 4, 2010 (GB) ..... 1003601.0
Feb. 4, 2011 (GB) ..... 1101946.0

(51) Int. Cl.
*A47L 5/00* (2006.01)

(52) U.S. Cl.
USPC ..... 15/319; 15/375; 15/376; 15/387; 15/390

(58) Field of Classification Search
USPC ..... 15/319, 375, 376, 387, 390
IPC ..... A47L 5/00,5/10
See application file for complete search history.

(56) References Cited

U.S. PATENT DOCUMENTS 7,441,307 B2 * 10/2008 Smith ..... 15/387
7,861,368 B2 * 1/2011 Hackwell et al. ..... 15/387
7,941,893 B2 5/2011 Woerwag
8,387,207 B2 * 3/2013 Dimbylow et al. ..... 15/375
2011/0214248 A1 9/2011 McLeod et al.
2011/0214252 A1 9/2011 McLeod et al.

FOREIGN PATENT DOCUMENTS

DE 198 26 041 11/1999
DE 10 2006 040 557 3/2008
DE 10 2008 010 334 8/2009
EP 0 064 161 11/1982

(Continued)

OTHER PUBLICATIONS

GB Search Report dated Jul. 1, 2010, directed to counterpart GB Application No. 1003601.0; 1 page.

(Continued)

*Primary Examiner* — David Redding
(74) *Attorney, Agent, or Firm* — Morrison & Foerster LLP

(57) ABSTRACT

A vacuum cleaning appliance includes a vacuum cleaning head having a suction opening, the head having a first state and a second state, a fan unit for drawing an air flow through the suction opening, and a control assembly for controlling the state of the head. The control assembly includes a user-operable valve for increasing temporarily an air pressure within an airflow path extending from the suction opening to the fan unit, a pressure chamber having an interior volume in fluid communication with the airflow path, the pressure chamber being moveable from an expanded configuration to a contracted configuration in response to a pressure difference between the interior volume and ambient air, the pressure chamber being biased towards the expanded configuration, and a control mechanism for allowing the pressure chamber to move to the contracted configuration in response to a first operation of the valve to place the head in one of the first and second states, and for preventing the pressure chamber from returning to the contracted configuration in response to a second operation of the valve to place the head in the other of the first and second states.

21 Claims, 27 Drawing Sheets

(56) References Cited

FOREIGN PATENT DOCUMENTS

| | | |
|---|---|---|
| EP | 1 839 548 | 10/2007 |
| GB | 247919 | 6/1926 |
| GB | 659039 | 10/1951 |
| GB | 2 252 900 | 8/1992 |
| GB | 2 253 780 | 9/1992 |
| GB | 2 266 230 | 10/1993 |
| GB | 2471919 | 1/2011 |
| GB | 2471920 | 1/2011 |
| JP | 6-86744 | 3/1994 |
| JP | 8-215117 | 8/1996 |
| JP | 9-47386 | 2/1997 |
| JP | 9-182697 | 7/1997 |
| JP | 2005-237733 | 9/2005 |
| JP | 2007-68957 | 3/2007 |
| JP | 2009-18073 | 1/2009 |
| WO | WO-99/65376 | 12/1999 |
| WO | WO-2004/028330 | 4/2004 |
| WO | WO-2011/007160 | 1/2011 |

OTHER PUBLICATIONS

International Search Report and Written Opinion mailed May 18, 2011, directed to corresponding International Application No. PCT/GB2011/050289; 14 pages.

GB Search Report dated May 19, 2011, directed to corresponding GB Application No. 1101946.0; 2 pages.

* cited by examiner

VACUUM CLEANING APPLIANCE

REFERENCE TO RELATED APPLICATIONS

This application claims the priority of United Kingdom Application No. 1003601.0, filed 4 Mar. 2010, and the United Kingdom Application No. 1101946.0, filed 4 Feb. 2011, the entire contents of which are incorporated herein by reference.

FIELD OF THE INVENTION

The present invention relates to a vacuum cleaning appliance.

BACKGROUND OF THE INVENTION

A vacuum cleaner typically comprises a main body containing dirt and dust separating apparatus, a floor tool connected to the main body and having a suction opening, and a motor-driven fan unit for drawing dirt-bearing air through the suction opening. The suction opening is directed downwardly to face the floor surface to be cleaned. The dirt-bearing air is conveyed to the separating apparatus so that dirt and dust can be separated from the air before the air is expelled to the atmosphere. The separating apparatus can take the form of a filter, a filter bag or, as is known, a cyclonic arrangement. The present invention is not concerned with the nature of the separating apparatus and is therefore applicable to vacuum cleaners utilizing any of the above arrangements or another suitable separating apparatus.

A driven agitator, usually in the form of a brush bar, is supported in the floor tool so as to protrude by a small extent from the suction opening. The brush bar is activated mainly when the vacuum cleaner is used to clean carpeted surfaces. The brush bar comprises an elongate cylindrical core bearing bristles which extend radially outward from the core.

Rotation of the brush bar may be driven by an electric motor powered by a power supply derived from the main body of the cleaner, or by an air turbine assembly driven by an air flow into the floor tool. The rotation of the brush bar causes the bristles to sweep along the surface of the carpet to be cleaned to loosen dirt and dust, and pick up debris. The suction of air generated by the fan unit of the vacuum cleaner causes air to flow underneath the floor tool and around the brush bar to help lift the dirt and dust from the surface of the carpet and then carry it from the suction opening through the floor tool towards the separating apparatus.

When the floor tool is to be used to clean a hard floor surface, it is desirable to stop the rotation of the brush bar to prevent the floor surface from becoming scratched or otherwise marked by the moving bristles of the brush bar. When the brush bar is driven by a motor, a switch may be provided on the floor tool to enable a user to de-activate the motor driving the rotation of the brush bar before the floor tool is moved on to the hard floor surface. Alternatively, a sensor may be provided on the bottom surface of the floor tool for detecting the type of floor surface upon which the floor tool has been located, and for deactivating the motor depending on the detected type of floor surface.

WO2004/028330 describes a mechanism for allowing a user to stop the rotation of a brush bar driven by an air turbine assembly. The turbine assembly comprises a vaned impeller which is mounted within a housing for rotation relative to a guide vane plate. The housing is located on one side of the floor tool. The impeller is connected to the brush bar by a pulley system. The housing has an air outlet connected to a suction duct extending between the suction opening and the main body of the vacuum cleaning appliance, and an air inlet for admitting ambient air into the housing. When the appliance is switched on, ambient air is drawn through the housing, causing the impeller to rotate and drive the rotation of the brush bar.

The mechanism comprises a movable button which is connected to the inlet side of the housing by an annular diaphragm seal. The seal is connected to a cylindrical outer wall of an inlet cap located over the air inlet of the housing. The inlet cap has a conical inner wall which defines with the button and the seal an airflow path for conveying air towards the vanes of the guide vane plate and the impeller. The button, inlet cap and guide vane plate define a pressure chamber which contains a spring for urging the button away from the guide vane plate. The guide vane plate comprises apertures which allow air to be evacuated from the pressure chamber through rotation of the impeller relative to the guide vane plate.

To stop the rotation of the brush bar, the user depresses the button to urge the seal against the inner wall of the inlet cap to block the air flow to the vanes. The lack of air flow through the housing causes the impeller and the brush bar to come to rest. The pressure chamber becomes evacuated under the pumping action of the fan of the vacuum cleaning appliance. The force acting on the button due to the pressure differential between the air inside the pressure chamber and the ambient air gradually becomes greater than the opposing force of the spring, with the result that when the user releases the button the seal remains urged against the inlet cap.

To restart the rotation of the brush bar during cleaning, the user opens a valve to admit air into the airflow downstream from the turbine assembly. This valve may be a suction release trigger located on a wand to which the floor tool is attached. Opening the valve lowers the pressure difference across the button to allow the spring to push the button away from the inlet cap to open the airflow path through the turbine assembly and restart the rotation of the impeller.

The stopping and re-starting of the brush bar thus requires two different user operations; to stop the brush bar the user must depress the button, whereas to re-start the brush bar the user must operate the suction release trigger on the wand. Furthermore, the depression of the button can be inconvenient for the user. The user has to either bend down to depress the button, or invert the wand to raise the floor tool towards hand or eye level.

SUMMARY OF THE INVENTION

The present invention provides a vacuum cleaning appliance comprising a vacuum cleaning head having a suction opening, the head having a first state and a second state, a fan unit for drawing an air flow through the suction opening, and a control assembly for controlling the state of the head, the control assembly comprising a user-operable valve for increasing temporarily an air pressure within an airflow path extending from the suction opening to the fan unit, a pressure chamber having an interior volume in fluid communication with the airflow path, the pressure chamber being moveable from an expanded configuration to a contracted configuration in response to a pressure difference between the interior volume and ambient air, the pressure chamber being biased towards the expanded configuration, and a control mechanism for allowing the pressure chamber to move to the contracted configuration in response to a first operation of the valve to place the head in one of the first and second states, and for preventing the pressure chamber from returning to the contracted configuration in response to a second operation of the valve to place the head in the other of the first and second states.

Where the vacuum cleaning head is connected to a main body of a vacuum cleaning appliance by a wand and hose assembly, the valve may be located on the wand, preferably in the vicinity of the handle of the wand. This can enable the user to vary the air pressure within the duct using a hand which is currently holding the wand, making the cleaner head easier to use. By sequentially opening and closing the valve to cause the air pressure in the duct to fluctuate between upper and lower values, the user can toggle the state of the control mechanism to selectively allow or prevent the pressure chamber from adopting its contracted configuration when the valve is closed, thereby selectively switching the state of the head. The change in the configuration of the pressure chamber can vary, for example, the state or position of an agitator for agitating dirt from a surface to be treated, a speed of rotation of such an agitator, or the relative positions of two other parts of the cleaning head. For example, a debris slot in the cleaning head may be selectively opened and closed by operating the valve, or a lint picker may be selectively raised and lowered by operating the valve.

The agitator may be in the form of a brush having a plurality of bristles, filaments or other surface agitating elements. The agitator may be moveable relative to the housing between active and inactive states, which correspond to the first and second states of the head, respectively. Alternatively, the agitator may be rotatable relative to the housing in its active state, and generally stationary relative to the housing in its inactive state. The agitator may comprise a disc or other generally planar member which is rotatable relative to the housing, or it may comprise an elongate brush bar having agitating elements extending radially outwardly therefrom.

The head preferably comprises a drive mechanism for rotating the agitator relative to the housing, the control assembly being arranged to deactivate the drive mechanism in response to the first operation of the valve, and to re-activate the drive mechanism in response to the second operation of the valve. The drive mechanism may comprise a motor which is deactivated in response to the first operation of the valve. Alternatively, the drive mechanism may comprise a drive belt which is moved from a pulley or gear to an idler to place the agitator in its inactive state, or a clutch which is placed in either an engaged position or a disengaged position to change the state of the agitator.

As another alternative, the drive mechanism may comprise an air turbine assembly comprising an impeller for driving the agitator, with the control assembly being arranged to inhibit rotation of the impeller to change the state of the agitator. For example a braking system may be fitted to the drive shaft of the impeller, with the control assembly being arranged to deploy the braking system to engage the drive shaft or a braking surface extending about the drive shaft to reduce the speed of rotation of the impeller. Alternatively, a clutch may be provided for selectively disengaging the drive shaft from the agitator. Preferably though, the control assembly is arranged to inhibit air flow to the impeller to stop the rotation of the impeller, thereby placing the agitator in an inactive state. The head may comprise a turbine air inlet, separate from the suction opening, for admitting a second air flow to the turbine assembly, and so the control assembly may comprise a closure member which is moveable between an open position and a closed position for substantially closing the turbine air inlet to inhibit the flow of air to the impeller. The closure member preferably comprises a seal for sealing the turbine air inlet when the closure member is in the closed position. The closure member is preferably biased towards the open position, which can assist in moving the pressure chamber from the contracted configuration towards the expanded configuration when the valve is operated.

Preferably, the duct comprises an entrainment chamber in which the air flow from the suction opening merges with the air flow from the turbine assembly. The pressure chamber may be connected to the airflow path immediately downstream from the entrainment chamber. Alternatively, the pressure chamber may be connected to the airflow path via a turbine chamber housing the turbine assembly. For example, the turbine assembly may be located within a turbine chamber through which the second air flow passes from the turbine air inlet to the duct, and so is in fluid communication with the duct, and the control mechanism may comprise a duct which extends from the turbine chamber to the pressure chamber.

The control mechanism preferably has a first state for preventing the pressure chamber from adopting the contracted configuration, and a second state for allowing the pressure chamber to adopt the contracted configuration, the control mechanism being arranged to change between the first and second states in response to an increase in the interior volume of the pressure chamber. The control mechanism is preferably arranged to adopt the first state when there is substantially no pressure difference between the interior volume and the ambient air, for example when the vacuum cleaning appliance is switched off so that there is no air flow along the airflow path. As a result, each time the vacuum cleaning appliance is switched on, the head will always be in a default one of the first and second states, for example in a state in which an agitator is in an active state for agitating a floor surface, to provide certainty for the user.

The pressure chamber preferably comprises a first chamber section and a second chamber section which is moveable relative to the first chamber section. The first chamber section is preferably connected to a housing of the head. The first chamber section and the second chamber section may be connected by an annular seal to allow the second chamber section to move relative to the first chamber section while maintaining an air-tight seal between the sections of the pressure chamber. In this case, the movement of the second chamber section relative to the first chamber section actuates the control assembly to change the state of the head. The actuation of the control assembly may be effected by a non-contact technique, for example using a magnetic, electrical or optical technique for actuating the control assembly based on the relative positions between the first and second chamber sections. The control assembly may comprise an actuator connected to the second chamber section for actuating the change in the state of the head. For example, the control assembly may comprise a first arm connected to the second chamber section, and a second arm connected to the actuator, with the first arm being connected, either directly or indirectly, to the second arm. The first arm is preferably moveable relative to the second arm when the control mechanism is in the first state so that movement of the second chamber section relative to the first chamber section does not actuate the actuator. The control mechanism must then be placed in the second state to allow the pressure chamber to adopt its contracted configuration before the first arm is able to move the second arm to actuate the actuator. The pressure chamber may be located on the opposite side of the duct to the actuator, and so the arms may extend over, or beneath, the duct.

The pressure chamber may be formed from material which is internally biased or otherwise constructed to urge the pressure chamber towards its expanded configuration. Preferably though, the pressure chamber comprises at least one spring for urging the pressure chamber towards its expanded configuration. The second chamber section is preferably biased away from the first chamber section.

The pressure chamber may comprise two springs for urging the pressure chamber towards its expanded configuration. The first spring may be arranged to control the switching of the control mechanism between its first and second states, whereas the second spring may be arranged to urge the control mechanism into its first state when the pressure difference between the interior volume and the ambient air decreases to zero. For example, the pressure chamber may comprise an intermediary member located between the first and second chamber sections, a first spring for biasing the intermediary member away from the first chamber section, and a second spring for biasing the second chamber section away from the intermediary member. The control mechanism may extend about the intermediary member. The control mechanism may conveniently be formed with a stop for restricting the movement of the intermediary member away from the first chamber section under the action of the first spring.

The two springs are preferably axially aligned. The first spring preferably has a higher spring constant than the second spring so that the second spring remains in a compressed configuration while the first spring effects the transition of the control mechanism between the first and second states.

The control mechanism preferably comprises a track carrier connected to the first chamber section, and a track follower which is moveable with the second chamber section for movement relative to the track carrier, the track carrier comprising a track for guiding movement of the track follower relative to the track carrier as the configuration of the pressure chamber varies. Both of the track carrier and the track follower may be located within the pressure chamber. The track follower preferably extends about the track carrier, which is preferably cylindrical in shape. The track follower is preferably retained by the second chamber section so that the track follower is moveable both axially and rotationally relative to the track carrier. The track follower is preferably rotatable relative to the second chamber section as the second chamber section moves towards or away from the first chamber section depending on the balance of the forces applied thereto due to the spring constant of the springs and the pressure differential thereacross.

A transition of the control mechanism from the first state to the second state corresponds to a movement of the track follower relative to the track carrier from a first position in which, due to the shape of the track, the second chamber section is unable to move sufficiently towards the first chamber section, under the force applied thereto due to the pressure differential across the second chamber section, to actuate the actuator, to a second position in which the shape of the track allows the track follower subsequently to move along the track carrier so that the pressure chamber contracts sufficiently to cause the actuator to change the state of the agitator. This movement of the track follower from the first position to the second position results from an increase in the interior volume of the pressure chamber due to the user opening the valve to admit air into an airflow path extending from the suction opening to a fan unit.

The track follower may adopt a range of different positions relative to the track carrier when the control mechanism is in each of the first and second states. The control mechanism may be considered to be in a first state when the track follower is in a position relative to the track carrier from which the pressure chamber is unable to adopt the contracted configuration when the pressure differential across the second chamber section is relatively high, and to be in a second state when the track follower is in a position relative to the track carrier from which the pressure chamber is able to adopt the contracted configuration when the pressure differential across the second chamber section is relatively high.

BRIEF DESCRIPTION OF THE DRAWINGS

An embodiment of the present invention will now be described, by way of example only, with reference to the accompanying drawings, in which:

FIG. 9(*b*) is a top view of part of the floor tool, with the rear section of the main body removed, when the pressure chamber is in the expanded configuration;

FIG. 12(*b*) is a similar view to FIG. 9(*b*) when the pressure chamber is in the first partially contracted configuration;

FIG. 13(*b*) is a perspective view of a vacuum cleaning appliance including the wand and floor tool of FIG. 13(*a*);

FIG. 14(*b*) is a front right perspective view, from above, of the handle, with part of the handle removed;

FIG. 14(*c*) is a right side view of the handle, with the valves of the handle in a closed position;

FIG. 14(*d*) is a side sectional view of the handle, with the valves of the handle in the closed position;

FIG. 15(*b*) is a side sectional view of the handle, with the valves of the handle in the open position;

FIG. 16(*b*) is a similar view to FIG. 9(*b*) when the pressure chamber is in the second partially contracted configuration;

FIG. 17(*b*) is a similar view to FIG. 9(*b*) when the pressure chamber is in the first, fully contracted configuration;

FIG. 18(*b*) is a similar view to FIG. 9(*b*) when the pressure chamber is in the second, fully contracted configuration.

DETAILED DESCRIPTION OF THE INVENTION

Figure 1:
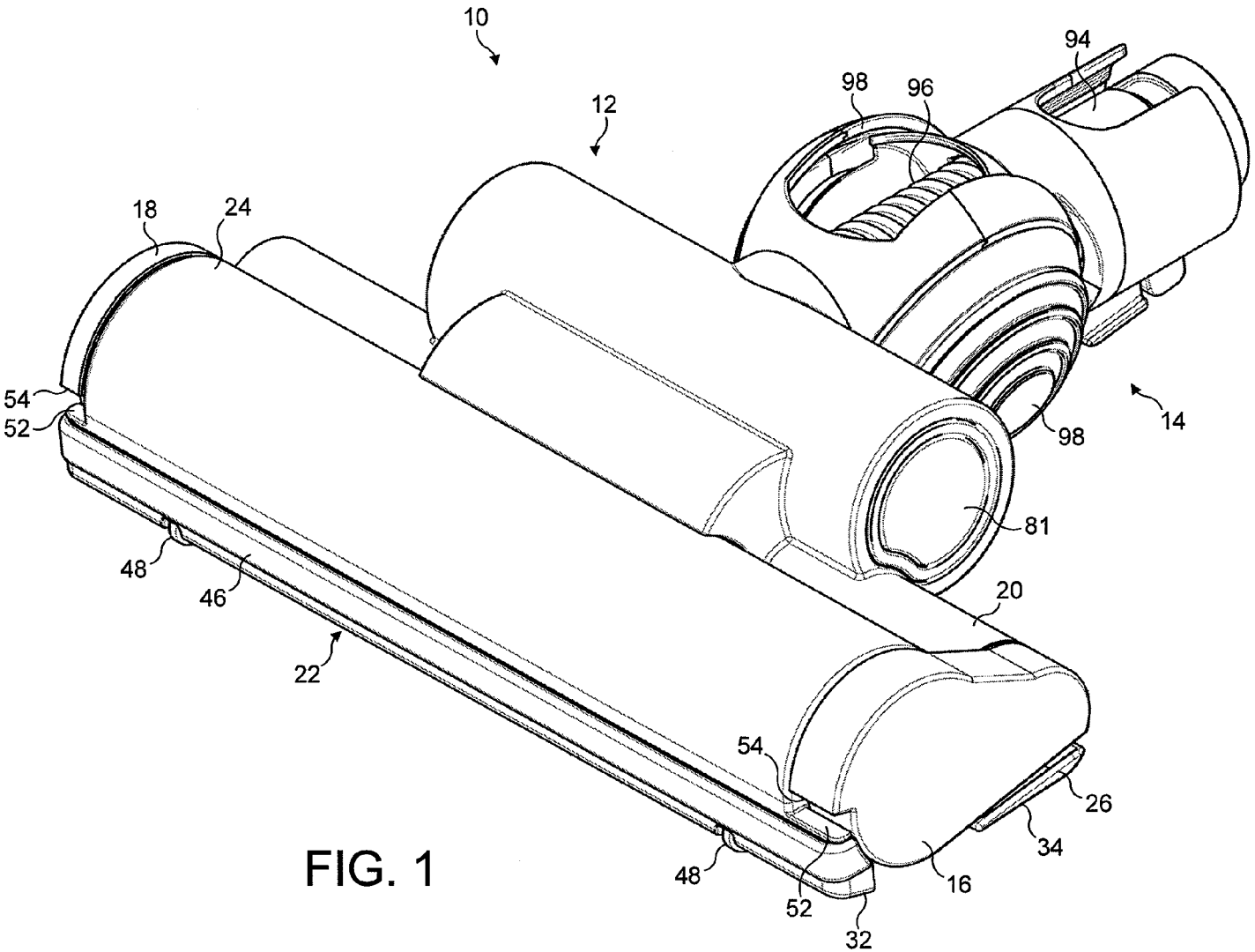
FIG. 1 is a front left perspective view, from above, of a floor tool for a vacuum cleaning appliance.
Figure 2:
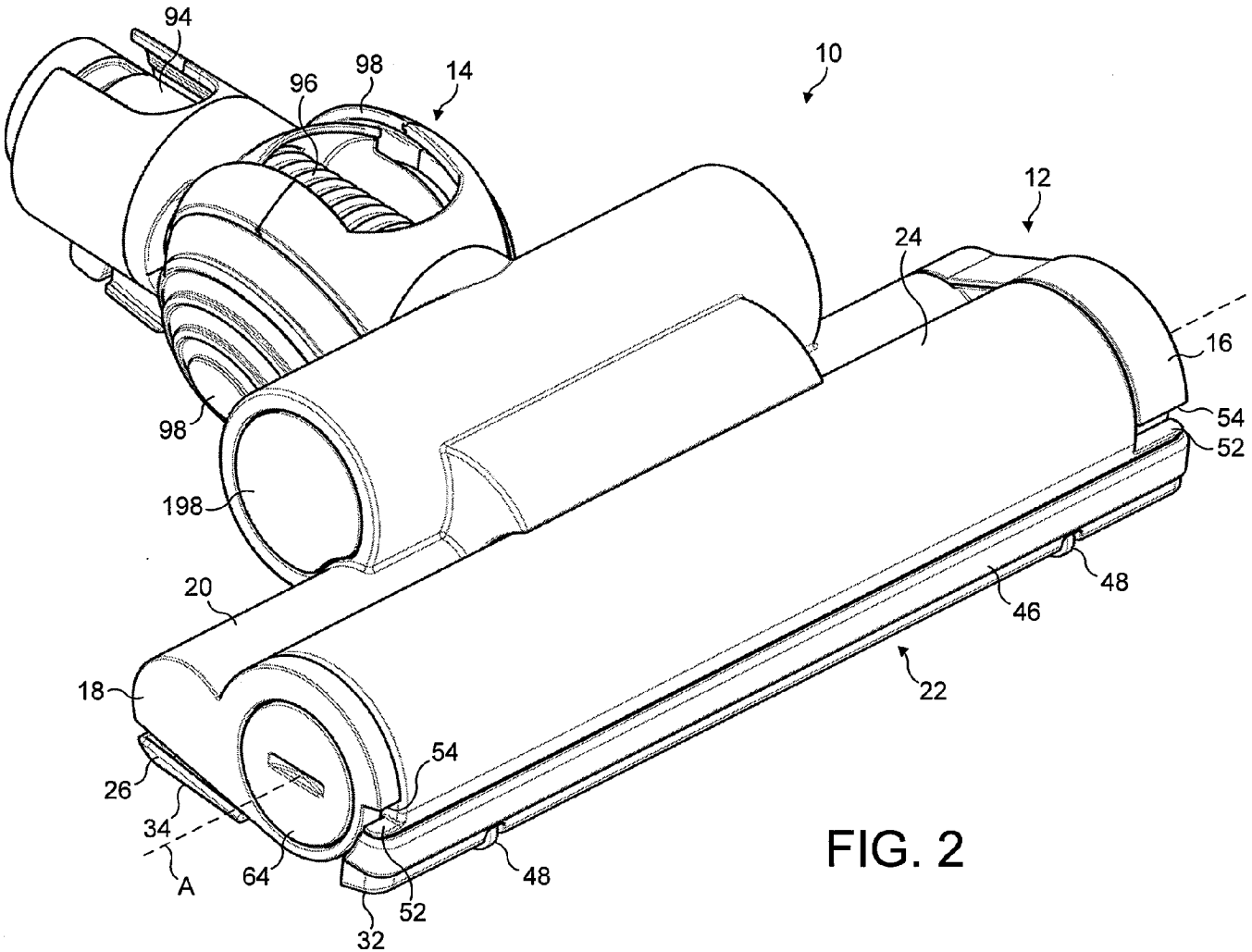
FIG. 2 is a front right perspective view, from above, of the floor tool of FIG. 1.
Figure 3:
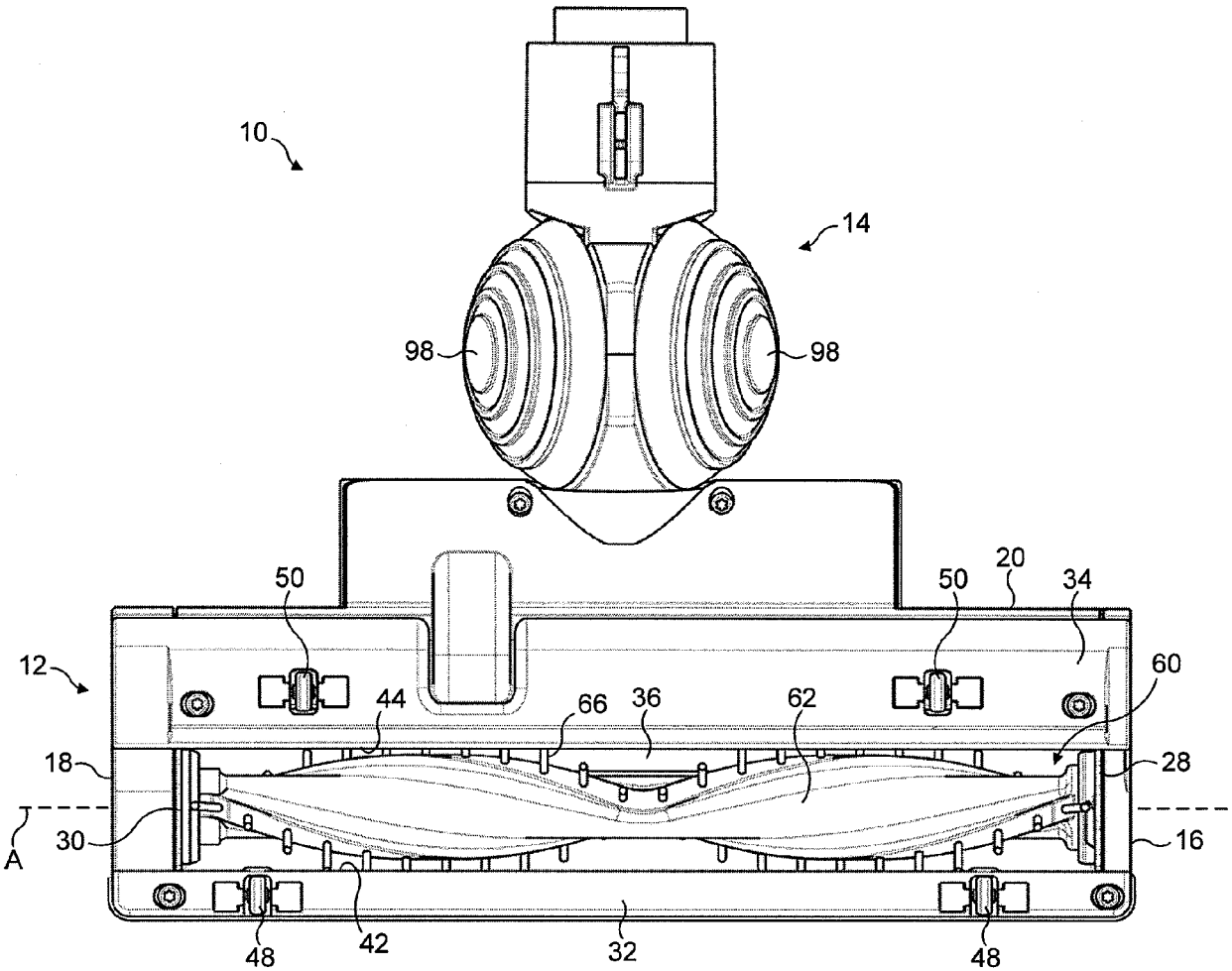
FIG. 3 is a bottom view of the floor tool of FIG. 1.

FIGS. 1 to 4 illustrate an embodiment of a floor tool 10 for a vacuum cleaning appliance. In this embodiment, the floor tool 10 is arranged to be connectable to a wand or hose of a cylinder vacuum cleaning appliance. The floor tool 10 comprises a main body 12 and a conduit 14 connected to the body 12. The main body 12 comprises substantially parallel side walls 16, 18 extending forwardly from opposite ends of a rear section 20 of the main body 12, and a moveable section 22 located between the side walls 16, 18 of the main body 12. In this embodiment the moveable section 22 is rotatably connected to the main body 12 for rotation about an axis A which extends generally orthogonally between the side walls 16, 18 of the main body 12.

The moveable section 22 comprises a curved upper wall 24, a lower plate, or sole plate 26, and two side walls 28, 30 which connect the sole plate 26 to the upper wall 24. The side walls 28, 30 are located between the side walls 16, 18 of the main body 12, with each side wall 28, 30 being located adjacent and substantially parallel to a respective one of the side walls 16, 18 of the main body 12. In use, the sole plate 26 faces the floor surface to be cleaned and, as described in more detail below, engages the surface of a carpeted floor surface. The sole plate 26 comprises a leading section 32 and a trailing section 34 located on opposite sides of a suction opening 36 through which a dirt-bearing air flow enters the floor tool 10. The suction opening 36 is generally rectangular in shape, and is delimited by the side walls 28, 30, a relatively long front wall 38 and a relatively long rear wall 40 which each upstand from the bottom surface of the sole plate 26. These walls also delimit the start of a suction passage through the main body 12 of the floor tool 10.

The sole plate 26 comprises two working edges for agitating the fibers of a carpeted floor surface as the floor tool 10 is maneuvered over such a surface. A front working edge 42 of the sole plate 26 is located at the intersection between the front wall 38 and the bottom surface of the leading section 32 of the sole plate 26, and extends substantially uninterruptedly between the side walls 28, 30. A rear working edge 44 of the sole plate 26 is located at the intersection between the rear wall 40 and the bottom surface of the trailing section 34 of the sole plate 26, and extends substantially uninterruptedly between the side walls 28, 30. At least the front working edge 42 is preferably relative sharp, preferably having a radius of curvature less than 0.5 mm.

A front bumper 46 is over-molded on to the moveable section 22, and is located between the upper wall 24 and the sole plate 26.

Figure 4:
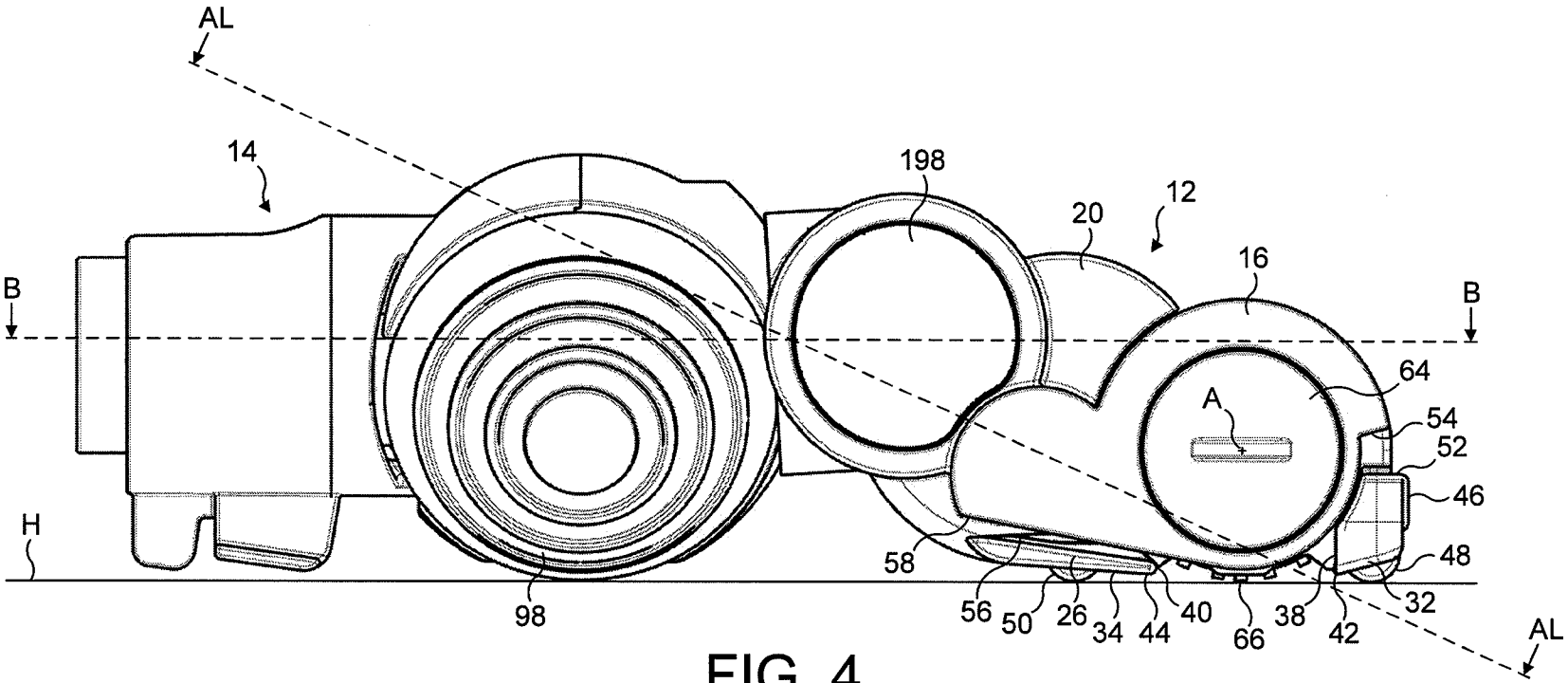
FIG. 4 is a right side view of the floor tool of FIG. 1.
Figure 5:
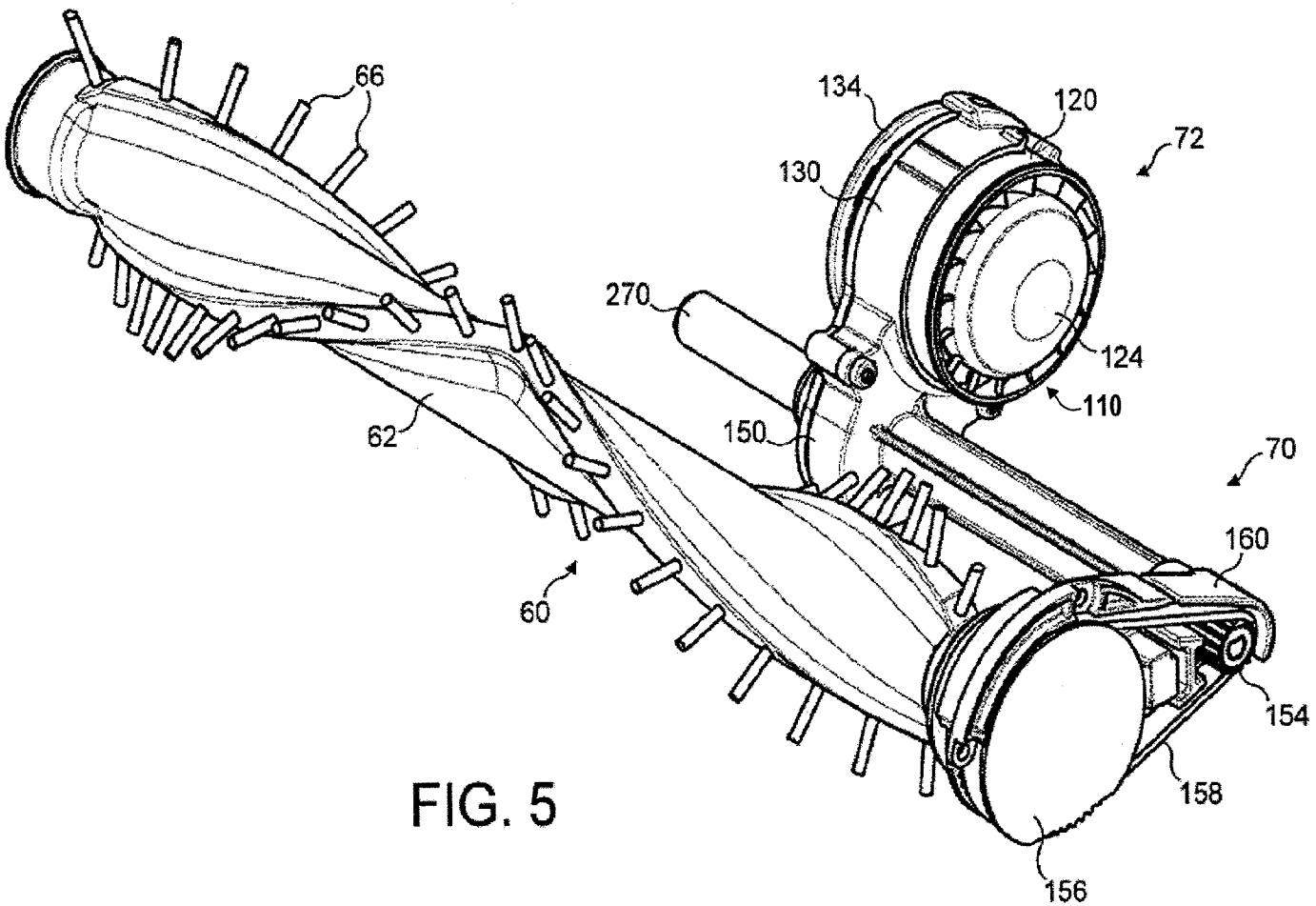
FIG. 5 is a front left perspective view, from above, of an agitator of the floor tool of FIG. 1 and a drive mechanism for the agitator.
Figure 7:
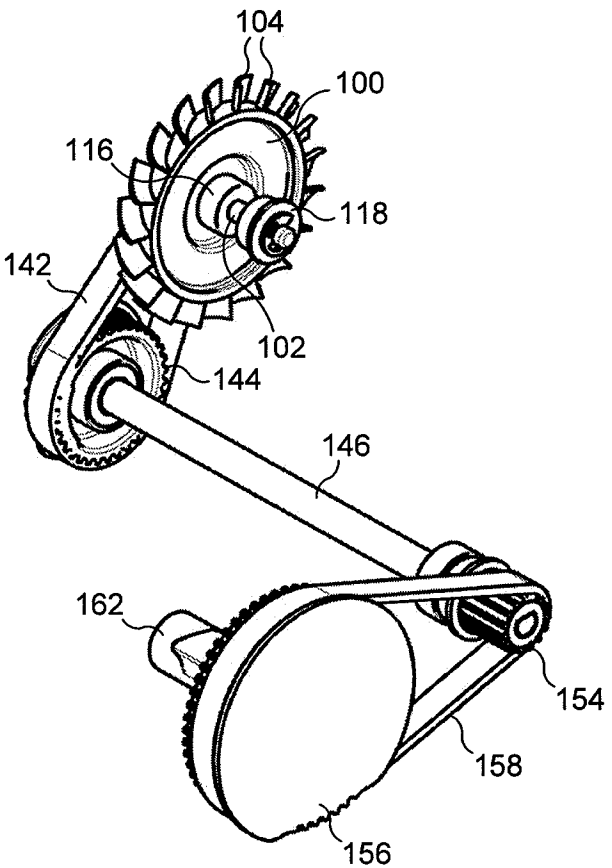
FIG. 7 is a similar view as FIG. 6, but with several static parts omitted.
Figure 6:
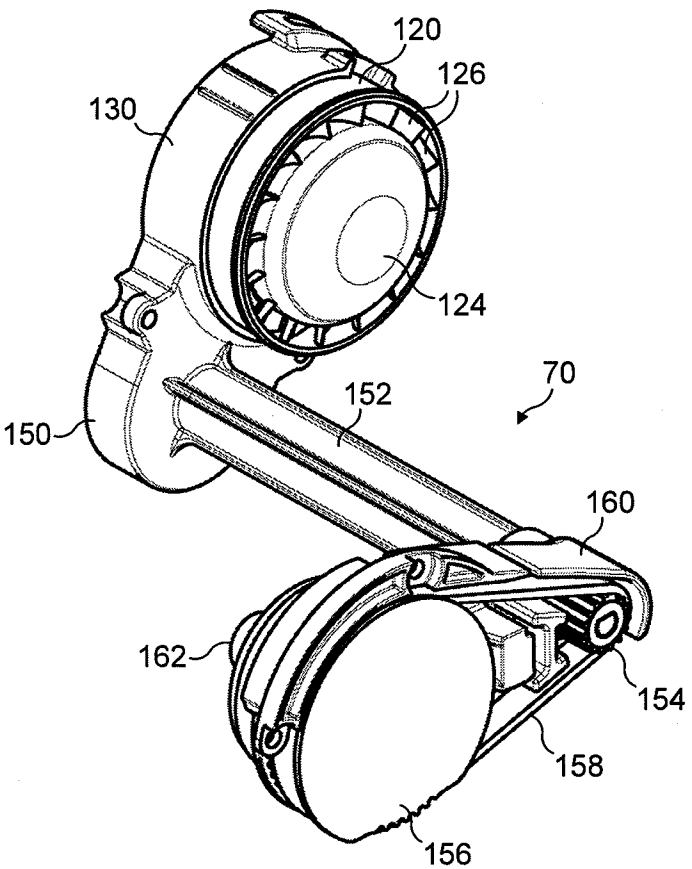
FIG. 6 is a front left perspective view, from above, of the drive mechanism of FIG. 5.

To prevent the working edges 42, 44 from scratching or otherwise marking a hard floor surface as the floor tool 10 is maneuvered over such a surface, the floor tool 10 comprises at least one surface engaging support member which serves to space the working edges 42, 44 from a hard floor surface. In this embodiment, the floor tool 10 comprises a plurality of surface engaging support members which are each in the form of a rolling element, preferably a wheel. A first pair of wheels 48 is rotatably mounted within a pair of recesses formed in the leading section 32 of the sole plate 26, and a second pair of wheels 50 is rotatably mounted within a pair of recesses formed in the trailing section 34 of the sole plate 26. As illustrated in FIG. 4, the wheels 48, 50 protrude downwardly beyond the working edges 42, 44 so that when the floor tool 10 is located on a hard floor surface H with the wheels 48, 50 engaging that surface, the working edges 42, 44 are spaced from the hard floor surface.

During use, a pressure difference is generated between the air passing through the floor tool 10 and the external environment. This pressure difference generates a force which acts downwardly on the floor tool 10 towards the floor surface. When the floor tool 10 is located on a carpeted floor surface, the wheels 48, 50 are pushed into the fibers of the carpeted floor surface under the weight of the floor tool 10 and the force acting downwardly on the floor tool 10. The thickness of the wheels 48, 50 is selected so that the wheels 48, 50 will readily sink into the carpeted floor surface to bring at least the working edges 42, 44 of the sole plate 26 into contact with the fibers of the floor surface. The thickness of the wheels 48, 50 is preferably less than 10 mm, more preferably less than 5 mm, to ensure that the wheels 48, 50 sink between the fibers of a carpeted floor surface. The bottom surface of the leading section 32 of the sole plate 26 is inclined upwardly and forwardly relative to a plane passing through the working edges 42, 44 of the sole plate 26. As a result, in use, the leading section 32 can guide the fibers of a rug or deeply piled carpeted floor surface beneath the floor tool 10 and into the suction opening 36 as the floor tool 10 is maneuvered forwardly over that floor surface, thereby lowering the resistance to forward motion of the floor tool 10 over the floor surface. The bottom surface of the trailing section 34 of the sole plate 26 is inclined upwardly and rearwardly relative to the plane passing through the working edges 42, 44 of the sole plate 26. As a result, in use, the trailing section 34 can guide the fibers of a rug or deeply piled carpeted floor surface beneath the floor tool 10 and into the suction opening 36 as the floor tool 10 is maneuvered rearwardly over that floor surface, thereby lowering the resistance to the rearward motion of the floor tool 10 over the floor surface.

As the floor tool 10 is pulled backwards over a carpeted floor surface by a user, there is a tendency for the user to raise the rear section 20 of the main body 12 of the floor tool 10. However, the rotatable connection of the moveable section 22 to the main body 12 allows the sole plate 26 to pivot relative to the main body 12 to maintain the working edges 42, 44 in contact with the floor surface. This can enable a seal to be maintained between the working edges 42, 44 and the floor surface during use, which can improve the pick up performance of the floor tool. Clockwise rotation of the moveable member 22 relative to the main body 12 (as viewed along axis A in FIG. 4) is restricted through the abutment of upwardly facing surfaces 52 located toward the ends of the bumper 46 of the moveable member 22 with downwardly facing surfaces 54 located towards the front of the side walls 16, 18 of the main body 12. Anticlockwise rotation of the moveable member 22 relative to the main body 12 is restricted through the abutment of the upper surface 56 of the trailing section 34 of the sole plate 26 with the bottom surfaces 58 of the side walls 16, 18 of the main body 12.

Returning to FIG. 3, the floor tool 10 further comprises an agitator 60 for agitating the fibers of a carpeted floor surface. In this embodiment the agitator 60 is in the form of a brush bar which is located within the suction passage and is rotatable relative to the main body 12 about axis A. The agitator 60 comprises an elongate body 62 which rotates about the longitudinal axis thereof. The body 62 passes through apertures formed in the side walls 28, 30 of the moveable member 22 so that one end of the body 62 can be supported by a removable portion 64 of the side wall 18 of the main body 12 for rotation relative to the main body 12, whereas the other end of the body 62 can be supported and rotated by a drive mechanism which is described in more detail below.

The agitator 60 further comprises surface engaging elements which in this embodiment are in the form of bristles 66 protruding radially outwardly from the body 62. The bristles 66 are arranged in a plurality of clusters, which are preferably arranged at regular intervals along the body 62 in one or more helical formations. The bristles 66 are preferably formed from an electrically insulating, plastics material. Alternatively, at least some of the bristles 66 may be formed from a metallic or composite material in order to discharge any static electricity residing on a carpeted floor surface.

FIGS. 5 to 8 and 9(*a*) illustrate a drive mechanism 70 for rotating the agitator 60 relative to the main body 12 of the floor tool 10. The drive mechanism 70 comprises an air turbine assembly 72 located within a turbine chamber 74. The turbine chamber 74 comprises an inner section 76 which is connected to, and is preferably integral with, one side of the rear section 20 of the main body 12, and an outer section 78 connected to the end of the inner section 76. The outer section 78 comprises an air inlet 80 through which an air flow may be drawn into the turbine chamber 74 through operation of a fan unit of the vacuum cleaning appliance to which the floor tool 10 is connected. A porous cover 81, such as a mesh screen, may be disposed over the air inlet 80 to inhibit the ingress of dirt and dust into the turbine chamber 74.

Air passing through the turbine chamber 74 is exhausted into an air duct 82 extending rearwardly from the rear section 20 of the main body 12 towards the conduit 14. The air duct 82 may be considered to form part of the suction passage through the main body 12. The air duct 82 comprises an inlet section 84 for receiving an air flow from an air outlet 86 of the main body 12, and a side inlet 88 for receiving an air flow exhausted from the turbine chamber 74. A mesh screen 89 may be provided adjacent the side inlet 89 to inhibit the ingress of dirt into the turbine chamber 74 from the side inlet 88. The inlet section 84 of the air duct 82 provides a flow restriction for throttling the air flow from the main body 12, and so the size of the outlet orifice of the inlet section 84 determines the ratio of the flow rate of air entering the floor tool 10 through the suction opening 36 to the flow rate of air entering the floor tool through the air inlet 80 of the turbine chamber 74. For example, when the outlet orifice is relatively small the flow rate of the air entering the floor tool 10 through the air inlet 80 will be greater than that entering the floor tool 10 through the suction opening 36. This will result in the agitator 60 being driven to rotate at a relatively high speed, but with a relatively low level of suction at the suction opening 36. On the other hand, when the outlet orifice is relatively large the flow rate of the air entering the floor tool 10 through the air inlet 80 will be smaller than that entering the floor tool 10 through the suction opening 36. This will result in the agitator 60 being driven to rotate at a relatively low speed, but with a relatively high level of suction at the suction opening 36. Therefore, the shape of the inlet section 84 can be chosen to provide the desired combination of agitator rotational speed and suction at the suction opening 36.

The air flow exhausted from the turbine chamber 74 merges with the air flow exhausted from the main body 12 within an entrainment chamber 90 located immediately downstream from the inlet section 84 of the air duct 82. This prevents the generation of eddy currents or other air circulating regions immediately downstream from the flow restriction defined by the inlet section 84 of the duct 82, and so reduces the pressure losses within the floor tool 10.

The duct 82 has an outlet section 91 located downstream from the entrainment chamber 90. The inlet orifice of the outlet section 91 of the duct 82 is located opposite to the outlet orifice of the inlet section 84 of the duct 82, and has a greater cross-sectional area orthogonal to the air flow therethrough than the outlet orifice of the inlet section 84 of the duct 82. The outlet section 91 of the air duct 82 is connected to an inlet section 92 of the conduit 14. The conduit 14 also comprises an outlet section 94 which is connectable to a hose, wand or other duct of a vacuum cleaning appliance, and a flexible duct 96 connected between the inlet section 92 and the outlet section 94 of the conduit 14. The conduit 14 is supported by a pair of wheels 98.

The turbine assembly 72 comprises an impeller 100 integral with, or mounted on, an impeller drive shaft 102 for rotation therewith. For example, the impeller 100 may be molded or pressed on to the impeller drive shaft 102. The impeller 100 comprises a circumferential array of equidistant impeller blades 104 arranged about the outer periphery of the impeller 100. The impeller 100 may be a single piece or assembled from two or more annular sections of sheet material each bearing an array of impeller blades 104. These sections of sheet material may be brought together, one over the other, to form the impeller 100, with the blades of one annular section alternately arranged with the blades of the other annular section.

The impeller drive shaft 102 is rotatably mounted in a stator 110 of the turbine assembly 72. The stator 110 comprises a first annular array of stator blades 112 which is arranged circumferentially about the outer periphery of an annular stator body 114 into which the impeller drive shaft 102 is inserted. The stator body 114 has substantially the same external diameter as the impeller 100, and the stator blades 112 are substantially the same size as the impeller blades 104. The impeller drive shaft 102 is supported within the bore of the stator body 114 by bearings 116, 118 so that the impeller blades 104 are located opposite to the stator blades 112. The stator body 114 is surrounded by a cylindrical stator housing 120 which defines with the stator body 114 an annular channel within which the stator blades 112 are located. The stator blades 112, stator body 114 and the stator housing 120 may be conveniently formed as a single piece. An annular, resilient support member 122 forms a seal between the outer surface of the stator housing 120 and the inner surface of the turbine chamber 74. The elasticity of the support member 122 is selected to minimize the transmission of vibrations from the turbine assembly 72 to the turbine chamber 74. The stator 110 further comprises a nose cone 124 which is mounted over the end of the stator body 114 which is remote from the impeller 100. The nose cone 124 includes a second annular array of stator blades 126 which is of a similar size as, and located adjacent to, the first array of stator blades 112. The outer surface of the nose cone 124 is shaped so as to guide an air flow into the annular channel between the stator body 114 and the stator housing 120.

The stator housing 120 is connected to, and preferably integral with, a cylindrical impeller housing 130, which defines with the impeller 100 an annular channel within which the impeller blades 104 are located. The impeller housing 130 is in turn connected to, and is preferably integral with, a turbine outlet conduit 134 which is mounted on the air duct 82 so that the outlet of the turbine outlet conduit 134 surrounds the side inlet 88 of the air duct 82. An annular sealing member 136 forms a seal between the side inlet 88 of the air duct 82 and the turbine outlet conduit 134.

The drive mechanism 70 further comprises a gear 140 mounted on the side of the impeller 100 opposite to the impeller drive shaft 102 for rotation with the impeller 100. A first belt 142 (shown in FIG. 7) connects the gear 140 to a drive pulley 144 mounted on one end of a drive shaft 146. To inhibit the ingress of dirt and dust within this part of the drive mechanism 70, and to prevent user contact with the drive mechanism 70, the first belt 142, the drive pulley 144 and the drive shaft 146 are housed within drive housing 150. The drive housing 150 is preferably integral with the impeller housing 130.

The drive shaft 146 is located within the rear section 20 of the main body 12, and is substantially parallel to the axis A. The drive shaft 146 is housed within drive shaft housing 152 which is preferably integral with the drive housing 150. A first driven pulley 154 is connected to the other end of the drive shaft 146. The first driven pulley 154 is connected to a larger, second driven pulley 156 by a second belt 158. A belt cover 160 extends partially about the second belt 158. A drive dog 162 is mounted on one side of the second driven pulley 158 for connection to the body 62 of the agitator 60.

Consequently, when an air flow is drawn through the turbine chamber 74 under the action of a motor-driven fan unit housed within a vacuum cleaning appliance attached to the outlet section 94 of the conduit 14 the impeller 100 is rotated relative to the turbine chamber 74 by the air flow. The rotation of the impeller 100 causes the drive pulley 142 to be rotated by the first belt 144. The rotation of the drive pulley 142 rotates the drive shaft 146 and the first driven pulley 154, and the rotation of the first driven pulley 154 causes the second driven pulley 156 to be rotated by the second belt 158. The rotation of the second driven pulley 156 results in the rotation of the agitator 60 relative to the main body 12.

The agitator 60 may be placed in an inactive state, in which the agitator 60 is stationary relative to the main body 12, during operation of the fan unit by selectively closing the entrance to the annular channel located between the outer surface of the stator body 114 and the stator housing 120 to inhibit air flow through the turbine chamber 74. Inhibiting the air flow through the turbine chamber 74 prevents the impeller 100 from rotating relative to the turbine chamber 74, which prevents the drive mechanism 70 from rotating the agitator 60 relative to the main body 12.

Returning to FIGS. 8 and 9(*a*), the turbine chamber 74 houses a resilient turbine seal 170 for closing the entrance to the annular channel to inhibit the air flow through the turbine chamber 74. The turbine seal 170 is generally in the form of a sleeve which is connected at one end thereof to the support member 122 and at the other end thereof to an annular member 172 of a turbine chamber control assembly 174, illustrated in FIG. 9(*b*). The outer surface of the turbine seal 170 passes, in turn, around the inner radial periphery, the outer end wall and the outer radial periphery of the annular member 172 before being connected to the annular member 172.

The control assembly 174 uses variation in air pressure within the air duct 82 to effect the movement of the turbine seal 170 relative to the turbine chamber 74. The annular member 172 thus provides an actuator of the control assembly 174 for actuating the change in the state of the agitator 60. The control assembly 174 comprises a pressure chamber 176 contained within a chassis 178 located on the opposite side of the air duct 82 to the turbine chamber 74. The chassis 178 comprises an inner section 180 which is connected to, and is preferably integral with, the other side of the rear section 20 of the main body 12, and an outer section 182 connected to the end of the inner section 180. The outer section 182 of the chassis 178 includes a central aperture 184.

The pressure chamber 176 is placed in fluid communication with the air duct 82 by a conduit 192 extending between the turbine chamber 74 and the pressure chamber 176. While the conduit 192 may be connected directly to the air duct 82, it is preferred to connect the conduit 192 to the turbine chamber 74 as the presence of the mesh screens 81, 89 for preventing the ingress of dirt into the turbine chamber 74 also prevents dirt from entering the pressure chamber 176 when the air duct 82 is connected to the turbine chamber 74. The pressure chamber 176 comprises a first chamber section 194 and a second chamber section 196. The first chamber section 194 comprises an end wall 198 which is located within the central aperture 184 of the outer section 182 of the chassis 178 and an annular outer side wall 200 which forms an interference fit with the inner surface of the outer section 182 of the chassis 178 so that the first chamber section 194 is secured to the chassis 178. The first chamber section 194 further comprises a cylindrical, first inner side wall 202 which is generally co-axial with the outer side wall 200, and a cylindrical, second inner side wall 203 which is generally co-axial with and surrounds the first inner side wall 202. The second chamber section 196 comprises an end wall 204 which is located opposite to, and generally parallel with, the end wall 198 of the first chamber section 194, and a stepped annular side wall 206.

A flexible, annular sealing member, which is preferably in the form of a sleeve 208 formed from rubber or other material having similar elastic properties, is connected to both the first chamber section 194 and the second chamber section 196 to form an airtight seal therebetween, and to allow the second chamber section 196 to move relative to the first chamber section 194 to vary the volume of the pressure chamber 176. One end 210 of the sleeve 208 is connected to the outer surface of the outer side wall 200 and the other end 212 of the sleeve 208 is connected to the outer surface of the side wall 206 so that the sleeve 208 surrounds the side walls 200, 206.

As discussed in more detail below, the pressure chamber 176 houses a control mechanism for controlling the configuration of the pressure chamber 176. The control mechanism comprises an annular track carrier 214 which is connected to the first chamber section 194. The track carrier 214 comprises an annular end wall 216, a generally cylindrical inner wall 218 and a generally cylindrical outer wall 220. A track 222 is located on the outer surface of the outer wall 220. The track carrier 214 is inserted between the inner walls 202, 203 of the first chamber section 194 so that the end wall 216 of the track carrier 214 is adjacent the end wall 198 of the first chamber section 194. The track carrier 214 is secured to the first chamber section 194 using a screw 224 or other suitable connector.

Figure 8:
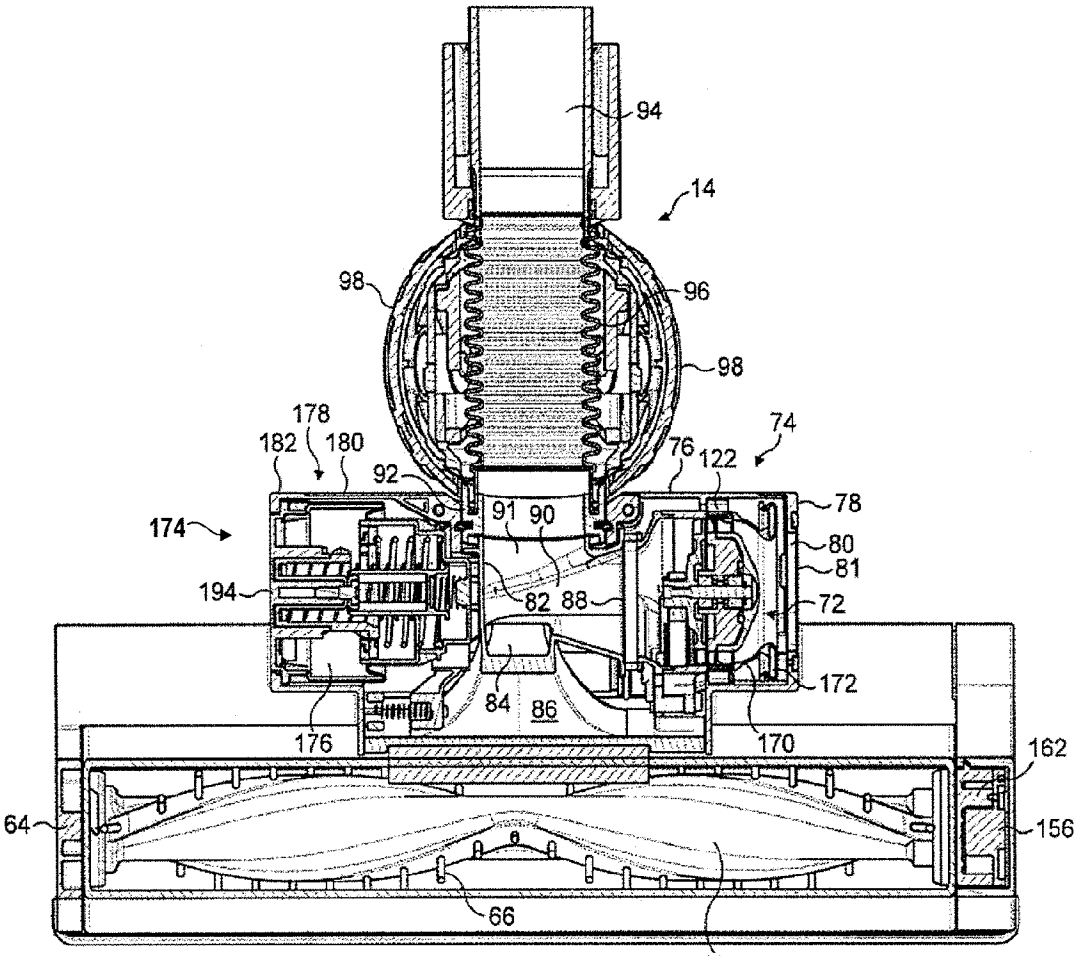
FIG. 8 is a sectional view of the floor tool, taken along line B-B in FIG. 4, with no air flow through the floor tool.
Figure 9A:
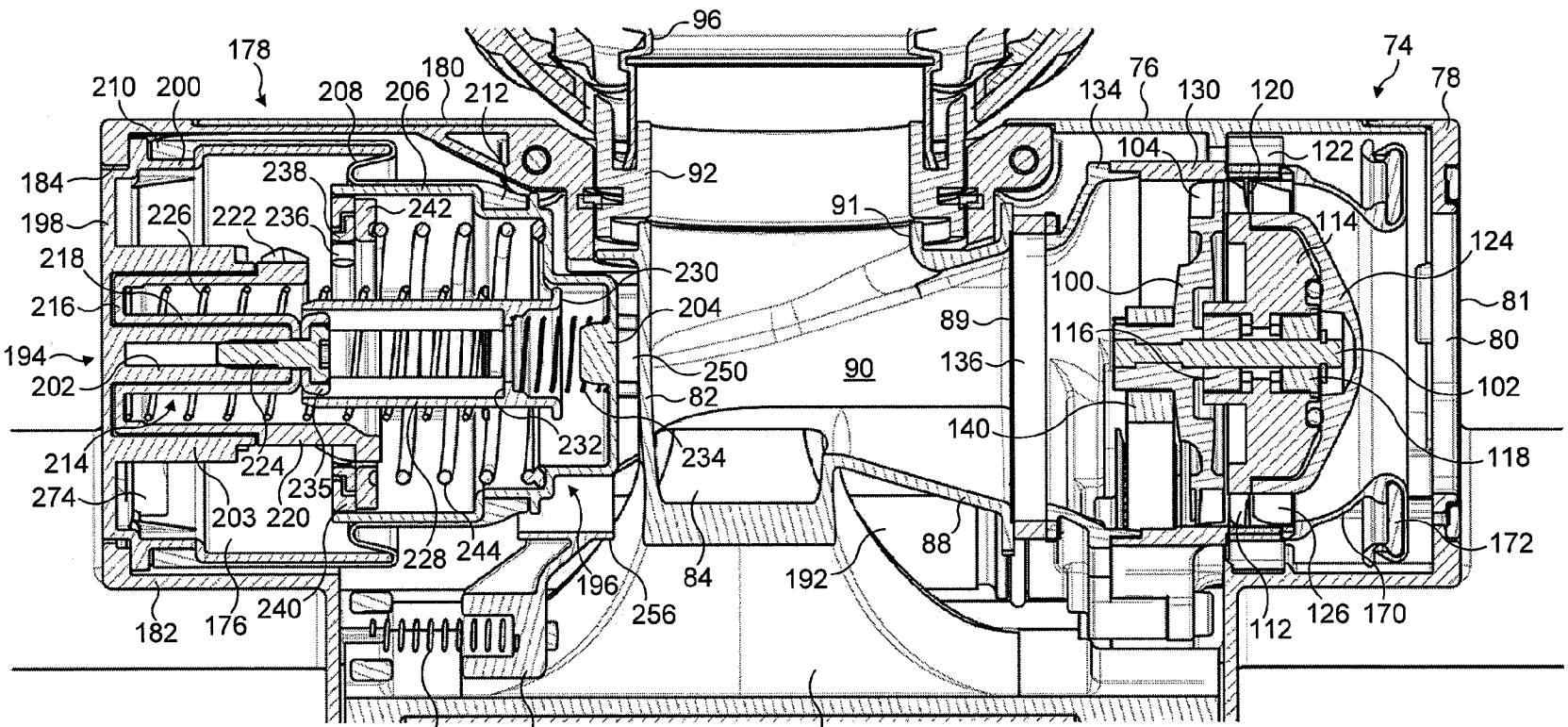
FIG. 9(*a*) is a close up of part of FIG. 8, with a pressure chamber of a turbine chamber control assembly of the floor tool in an expanded configuration.
Figure 9B:
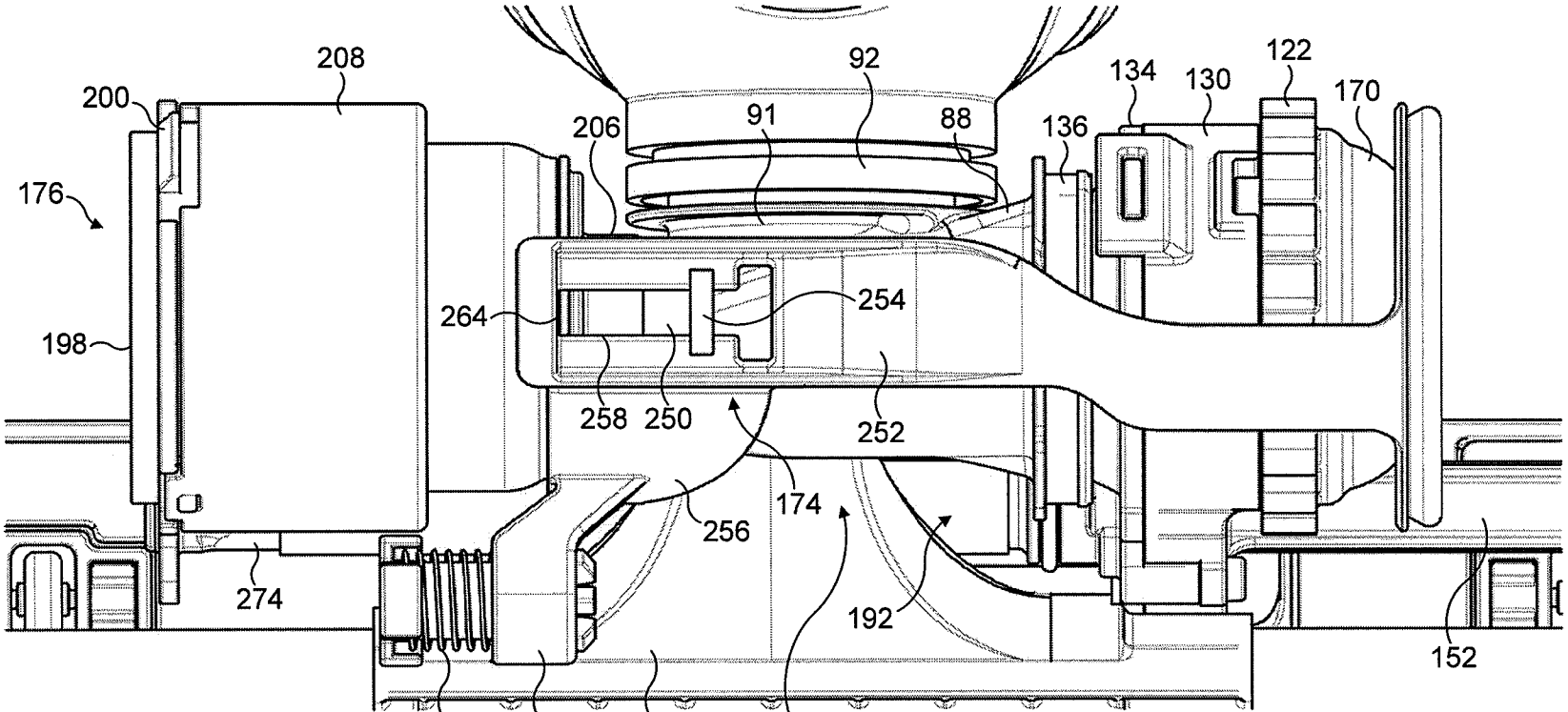

The control assembly 174 further comprises a plurality of resilient members, preferably in the form of helical compression springs, for urging the pressure chamber 176 towards an expanded configuration, as shown in FIGS. 8, 9(*a*) and 9(*b*). A first spring 226 has a first end which engages the end wall 216 of the track carrier 214, and a second end which extends about a tubular spring retainer 228 located between the first chamber section 194 and the second chamber section 196. The spring retainer 228 has a first annular spring abutment member 230 located on the outer surface thereof, and which is normally spaced from the second end of the first spring 226 when the pressure chamber 176 is in the configuration illustrated in FIG. 9(*a*). The spring retainer 228 also has a second annular spring abutment member 232 located on the inner surface thereof. A second spring 234 has a first end which engages the end wall 204 of the second chamber section 196 and a second end which engages the second annular spring abutment member 232. The second spring 234 thus serves to urge the second chamber section 196 away from the spring retainer 228, and therefore away from the first chamber section 194. The spring retainer 228 comprises a plurality of slots which extend from the second annular spring abutment member 232 towards an annular end of the spring retainer 228 which is remote from the first annular spring abutment member 230. A retainer clip 235 is secured to the end of the inner wall 218 of the track carrier 214 by the screw 224. The spring retainer 228 extends about the retainer clip 235. The retainer clip 235 comprises a pair of diametrically opposed lugs (not shown) which extend radially outwardly therefrom, and which each passes through a respective slot in the spring retainer 228. Engagement between the lugs and the annular end of the spring retainer 228 prevents the spring retainer 228 from moving away from the track carrier 214 beyond the position illustrated in FIG. 9(*a*).

Figure 11:
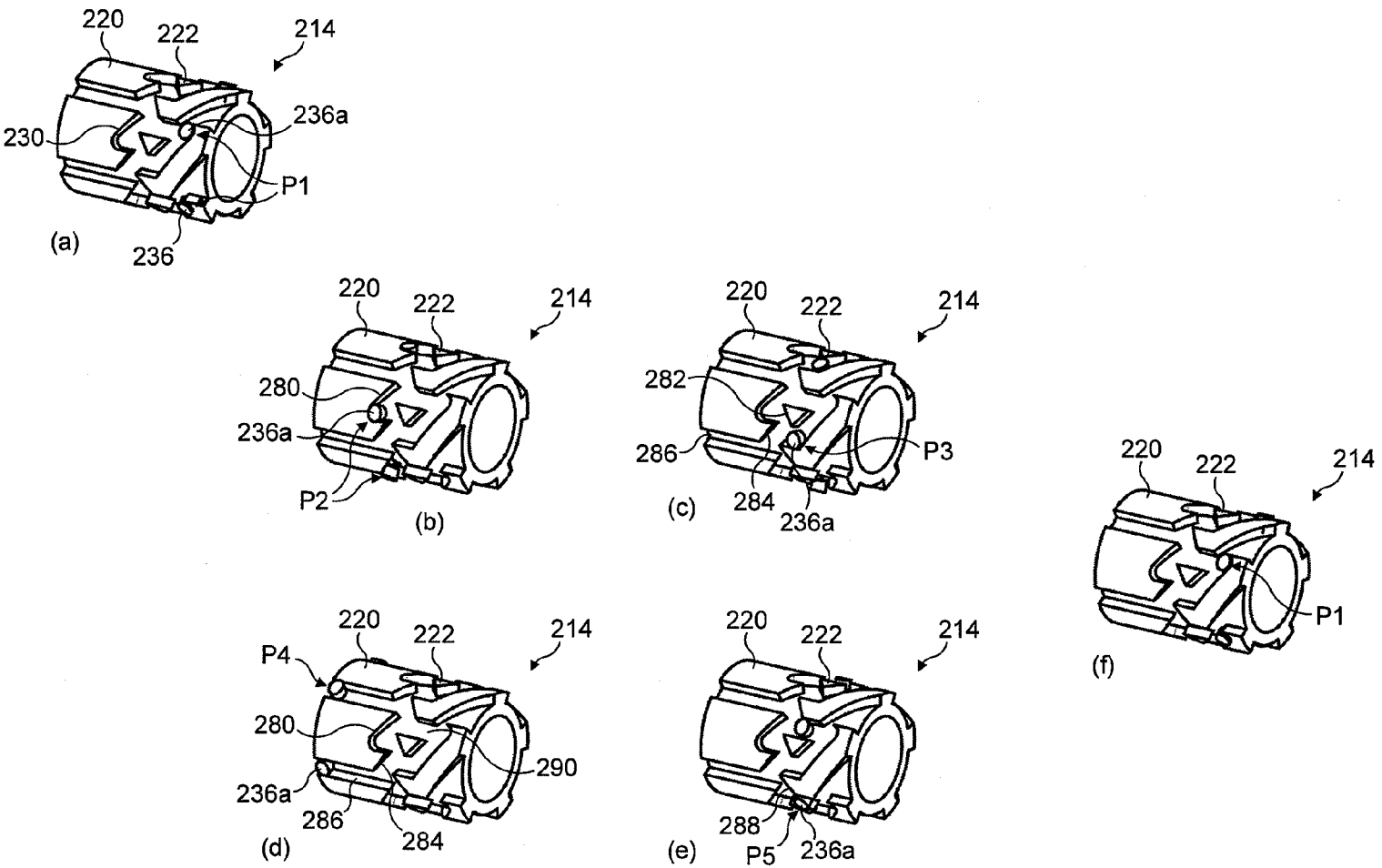
FIGS. 11(*a*) to (*f*) illustrate a series of external views of a track carrier of the control assembly, illustrating various different positions of a pin of a track follower of a control mechanism of the control assembly relative to the track carrier.

Part of the outer wall 220 of the track carrier 214 is illustrated in more detail in FIGS. 11(*a*) to 11(*f*). The track carrier 214 comprises a track 222 in the form of a series of irregular, interconnected grooves formed on the outer wall 220 of the track carrier 214. The track 222 is divided into a plurality of interconnected track sections, in this example five track sections, arranged circumferentially about the outer wall 220 of the track carrier 214. A plurality of pins 236, in this example five pins, is moveable along the track 222. The pins 236 are mutually angularly spaced by an angle of 72° so that, at any given instance, each pin 236 is located within a respective track section. Returning to FIG. 9(*a*), the pins 236 are arranged about the inner surface of an annular track follower 238 of the control mechanism. The track follower 238 is retained by a retaining ring 240 attached to the second chamber section 196 so that the track follower 238 is rotatable relative to both the second chamber section 196 and the track carrier 214, and is moveable axially relative to the track carrier 214. The track follower 238 is urged against the retaining ring 240 by an annular disc 242, which is in turn urged against the track follower 238 by a third spring 244 disposed between the annular disc 242 and the second chamber section 196.

Returning to FIG. 9(*b*), the control assembly 174 comprises a plurality of interconnected arms 250, 252 for connecting the second chamber section 196 to the annular member 172. Two first arms 250 are each connected at one end thereof to a respective one of two diametrically opposing locations on the end wall 204 of the second chamber section 196. Each of the first arms 250 extends over the upper surface of the air duct 82 towards the turbine assembly 72. Each first arm 250 has a locally enlarged end portion 254. Two second arms 252 are each connected at one end thereof to a respective one of two diametrically opposing locations on the annular member 172. Each second arm 252 extends over the turbine assembly 72, the air duct 82 and the first arm 250 towards the pressure chamber 176. The ends of the second arms 252 which are remote from the annular member 172 are connected by an arcuate connector 256. A slot 258 is located towards the other end of each second arm 252 for retaining the end portion 254 of a respective first arm 250 while permitting relative movement between the first arms 250 and the second arms 252. The second arms 252 are biased away from the pressure chamber 176 by a fourth spring 260 so that when the fan unit of the vacuum cleaning appliance is switched off, the fourth spring 260 urges the turbine seal 170 towards an expanded configuration illustrated in FIGS. 8 and 9(*a*), in which the inner surface of the turbine seal 170 is spaced from the outer surface of the nose cone 124 to permit air flow through the turbine chamber 74. The fourth spring 260 is located between the outer section 182 of the chassis 178 and an annular spring retainer 262 forming part of the connector 256.

Figure 10:
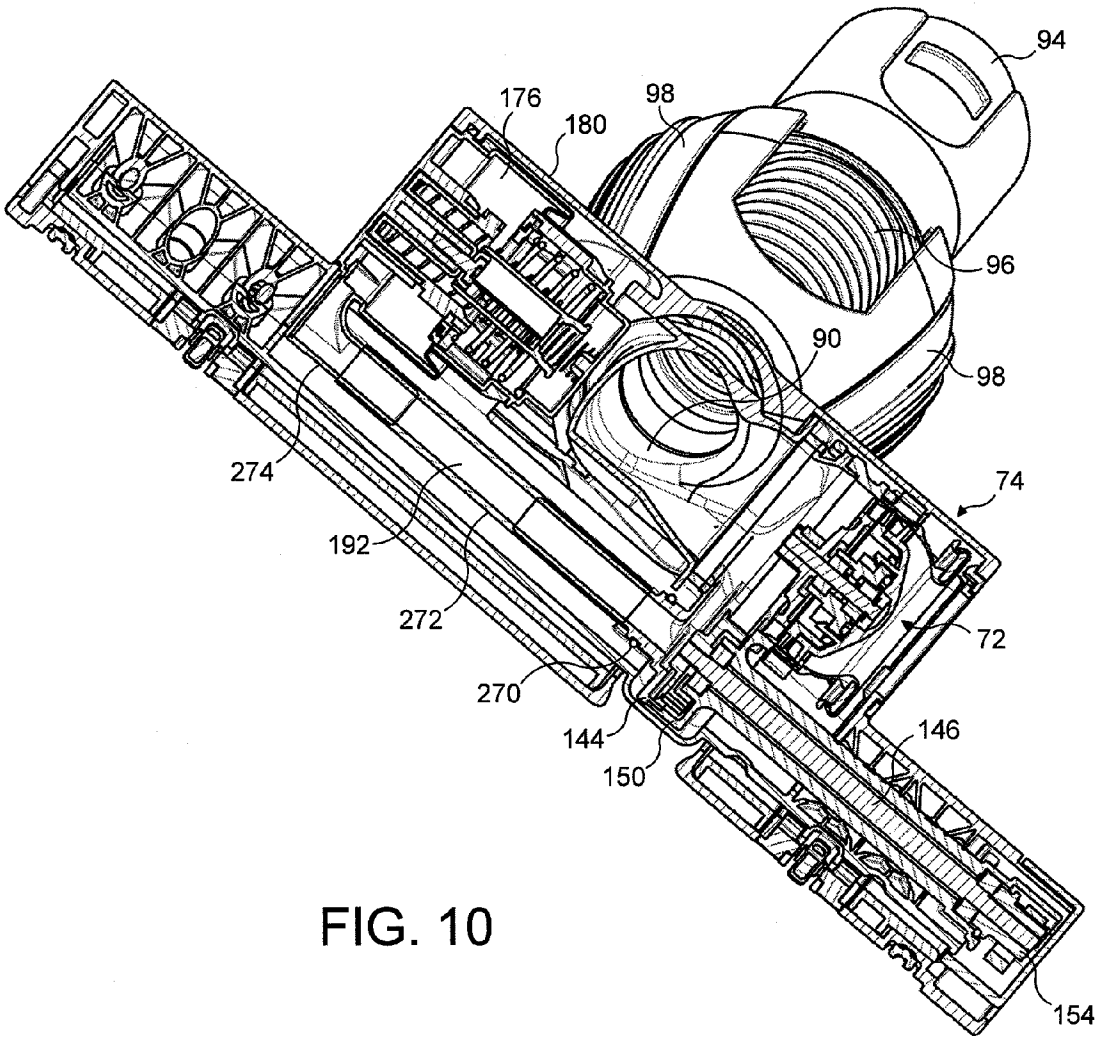
FIG. 10 is a sectional view taken along line AL-AL in FIG. 4.

The conduit 192 may be formed from a plurality of connected pipes or tubes. With reference to FIG. 10, the conduit 192 comprises an inlet pipe 270 which is integral with the turbine outlet conduit 134 and in fluid communication with the turbine chamber 74. The end of the inlet pipe 270 is inserted into one end of a connecting tube 272 which passes beneath the entrainment chamber 90 and the inlet 84 of the air duct 82. The other end of the connecting tube 272 received the end of an outlet pipe 274 of the conduit 192. The outlet pipe 274 is integral with the first chamber section 194 of the pressure chamber 176. As a result, the air pressure within the pressure chamber 176 will be substantially equal to the air pressure in the turbine chamber 74, which will in turn fluctuate with variations in the air pressure in the air duct 82. As the chassis 178 is not hermetically sealed, the air pressure surrounding the pressure chamber 176 will be maintained at or around atmospheric pressure.

As mentioned above, FIGS. 8, 9(*a*) and 9(*b*) illustrate the configuration of the control assembly 174 when the floor tool 10 is disconnected from a vacuum cleaning appliance, or when the vacuum cleaning appliance is switched off so that there is no air flow generated by the fan unit of the appliance. In this configuration, the air pressure within the pressure chamber 176 is the same as the air pressure outside the pressure chamber 176. The two springs 226, 234 within the pressure chamber 176 are in expanded configurations, urging the second chamber section 196 away from the first chamber section 194 with the result that the pressure chamber 176 is in an expanded configuration. The spring constant of the first spring 226 is preferably at least four times greater than the spring constant of the second spring 234. The spring constant of the third spring 244 is, in turn, greater than the spring constant of the first spring 226. With the pressure chamber 176 in this configuration, the second arms 252 of the control assembly 174 are urged by the fourth spring 260 towards the position shown in FIG. 9(*b*), in which the inner surface of the turbine seal 170 is spaced from the outer surface of the nose cone 124 to allow air to pass from the air inlet 80 of the turbine chamber 74 to the air duct 82.

When the vacuum cleaning appliance is switched on, rotation of the fan unit of the appliance causes a first air flow to be drawn into the main body 12 of the floor tool 10 through the suction opening 36, and a second air flow to be drawn into the turbine chamber 74 through the air inlet 80. As discussed above, the flow of air through the turbine chamber 74 causes the agitator 60 to rotate relative to the main body 12 of the floor tool 10. The first and second air flows merge within the entrainment chamber 90 of the air duct 82, and pass through the conduit 14 of the floor tool 10 to the outlet section 94 of the conduit 14.

As the air is drawn through the floor tool 10, the pressure at the inlet pipe 270 of the conduit 192 reduces from atmospheric pressure to a first, relatively low sub-atmospheric pressure. Consequently, the pressure of the air within the pressure chamber 176 also reduces to this relatively low pressure. As the air surrounding the pressure chamber 176 remains at or around atmospheric pressure, the pressure difference between the air within the pressure chamber 176 and the air outside the pressure chamber 176 generates a force which urges the second chamber section 196 towards the first chamber section 194.

The initial movement of the second chamber section 196 towards the first chamber section 194 causes the end wall 204 of the second chamber section 196 to move towards the spring retainer 228, against the biasing force of the second spring 234. The second spring 234 is compressed between the second chamber section 196 and the spring retainer 228 until the end wall 204 of the second chamber section 196 engages the spring retainer 228. Subsequent movement of the second chamber section 196 towards the first chamber section 194 causes the spring retainer 228 to move along with the second chamber section 196 towards the first chamber section 194 so that the first spring abutment member 230 engages the first spring 226. The spring constant of the first spring 226 is selected so that the first spring 226 is compressible under the action of the force acting on the second chamber section 196 when the pressure at the inlet pipe 270 of the conduit 192 is at the first, relatively low sub-atmospheric pressure, whereas the spring constant of the third spring 244 is selected so that the third spring 244 is relatively incompressible under the action of the force acting on the second chamber section 196 when the pressure at the inlet pipe 270 of the conduit 192 is at the first, relatively low sub-atmospheric pressure.

As the second chamber section 196 moves towards the first chamber section 194, the pins 236 of the track follower 238 move along the track 222 of the track carrier 214 from the positions P1 shown in FIG. 11(*a*) to the positions P2 shown in FIG. 11(*b*). In more detail, and with reference to pin 236*a* of the pins 236 to exemplify the movement of all of the pins 236, initially the pin 236*a* moves axially, that is, in the direction of the longitudinal axis of the annular track carrier 214, along the track 222 until the pin 236*a* abuts a curved wall 280. As the track follower 238 is rotatable about the track carrier 214, the pin 236*a* is able to move along the curved wall 280, under the action of the force exerted on the second chamber section 196 of the pressure chamber 176, until the pin 236*a* is in the position P2. In this position P2, the shape of the track 222 inhibits further axial movement of the second chamber section 196 towards the first chamber section 194, and thus prevents the pressure chamber 176 from moving into a fully contracted configuration. Therefore, while the first, relatively low sub-atmospheric pressure is sustained at the inlet pipe 270 the pins 236 remain in the positions P2. The control mechanism may thus be considered to be in a first state which inhibits the movement of the pressure chamber 176 to the fully contracted configuration.

Figure 12A:
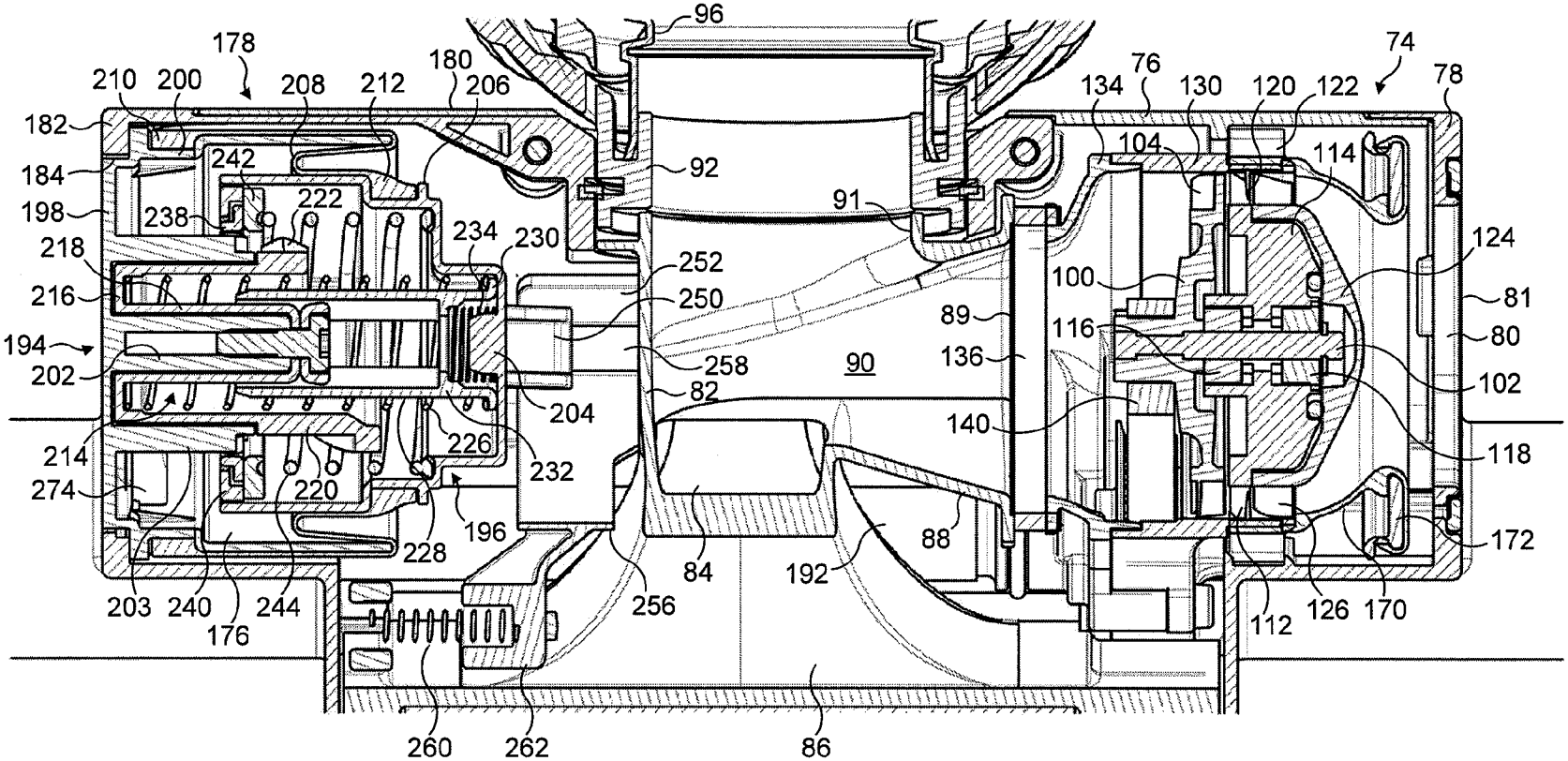
FIG. 12(*a*) is a similar view to FIG. 9(*a*), but with the pressure chamber in a first partially contracted configuration.
Figure 12B:
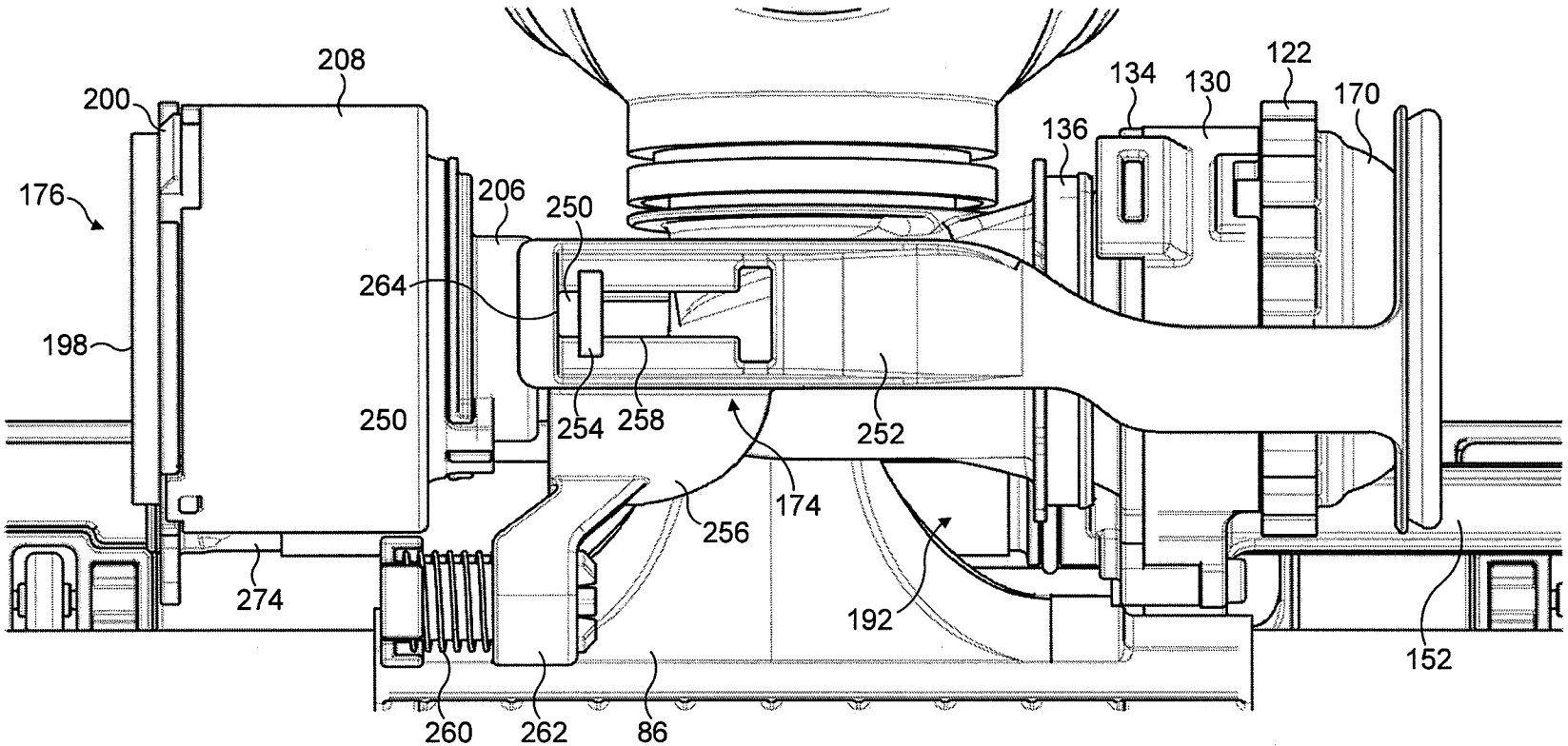

FIGS. 12(*a*) and 12(*b*) illustrate the configuration of the control assembly 174 when the pins 236 are in the positions P2. The pressure chamber 176 is in a first, partially contracted configuration in which the first annular spring abutment member 230 has engaged the end of the first spring 226 to partially compress the first spring 226, and the second spring 234 is fully compressed. With the movement of the second chamber section 196 towards the first chamber section 194, the first arms 250 of the control assembly 174 move relative to the second arms 252. The end portion 254 of each of the first arms 250 moves towards the end 264 of its respective slot 258, but does not come into contact with the end 264 of the slot 258 before the pins 236 reach the positions P2 in the track 222. The biasing force of the fourth spring 260 is selected so that the second arms 252 do not move with the first arms 250 as the first arms 250 move relative to the second arms 252. Therefore, while the control assembly 174 is in its first, partially contracted configuration the inner surface of the turbine seal 170 remains spaced from the outer surface of the nose cone 124 to permit air flow through the turbine chamber 74, with the result that the agitator 60 continues to rotate relative to the main body 12 of the floor tool 10.

As discussed above, when the floor tool 10 is located on a carpeted floor surface the wheels 48, 50 are pushed into the fibers of the carpeted floor surface under the weight of the floor tool 10 and the force acting downwardly on the floor tool 10 due to the pressure difference between the air passing through the floor tool 10 and the external environment. This brings the working edges 42, 44 of the sole plate 26 into contact with the fibers of the floor surface so that the fibers are agitated by the working edges 42, 44 as the floor tool 10 is maneuvered over the floor surface. The length of the bristles 66 of the agitator 60 is selected so that as the agitator 60 is rotated by the turbine assembly 72 the volume swept by the tips of the bristles 66 protrudes downwardly beyond the working edges 42, 44 to ensure that the bristles 66 can also agitate the fibers of the floor surface.

When the floor tool 10 is subsequently moved from a carpeted floor surface on to a hard floor surface, depending on the length of the bristles 66 it is possible that the bristles 66 could come into contact with and sweep over the hard floor surface. Depending on the nature of the hard floor surface, it may be desirable to inhibit the rotation of the agitator 60 before the floor tool 10 is moved on to the hard floor surface to prevent scratching or other marking of the floor surface by the rotating bristles 66, while maintaining the air flow into the main body 12 through the suction opening 36 to draw dirt and debris into the floor tool 10.

As mentioned above, the rotation of the agitator 60 relative to the main body 12 is inhibited by selectively preventing air flow through the turbine chamber 74. Inhibiting the air flow through the turbine chamber 74 removes the rotational driving force acting on the impeller 100 of the turbine assembly 72, which in turn removes the rotational driving force acting on the agitator 60, thereby causing the agitator 60 to come to rest.

Figure 13A:
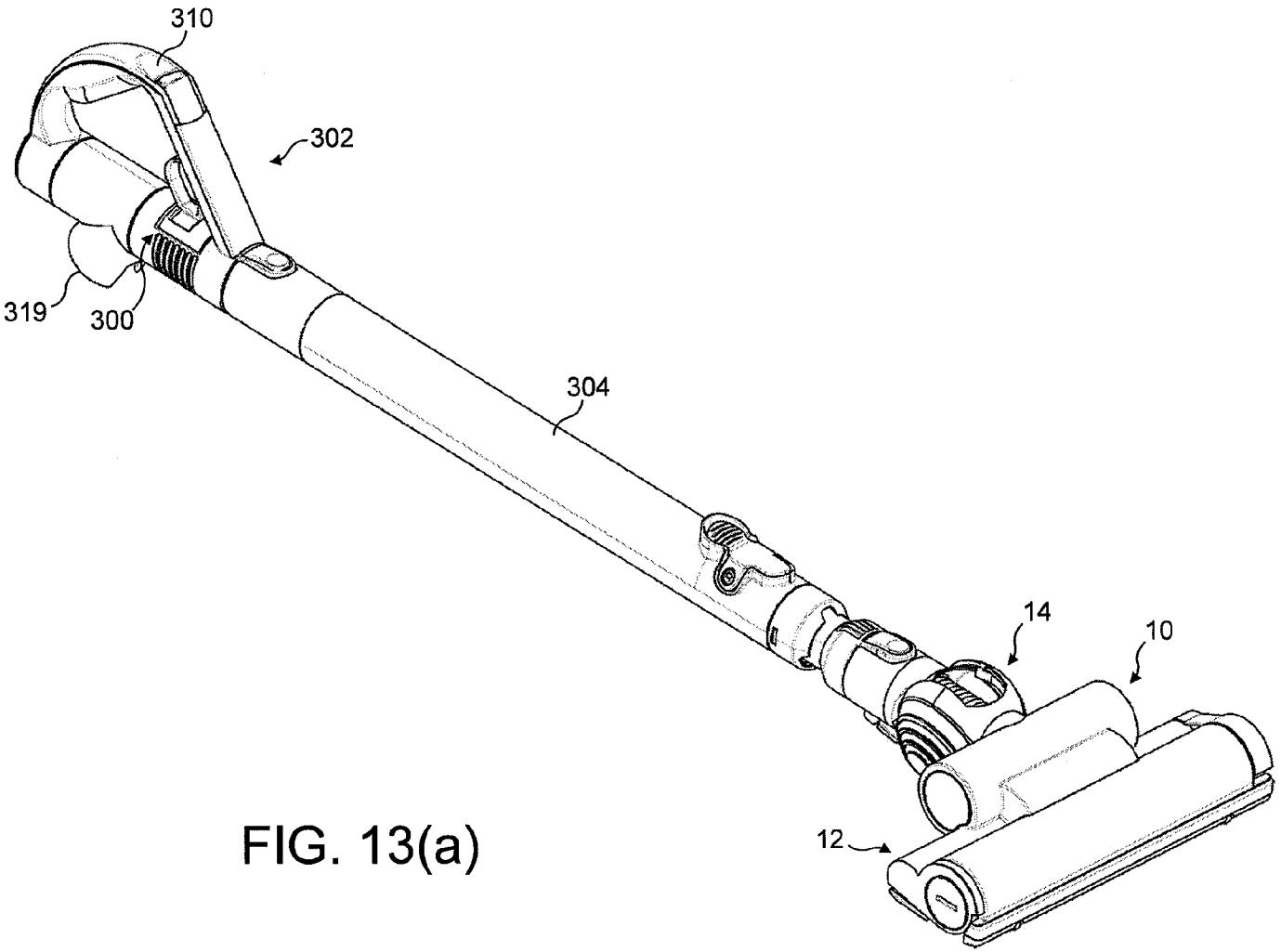
FIG. 13(*a*) is a front right perspective view, from above, of the floor tool of FIG. 1 connected to one end of a wand.
Figure 13B:
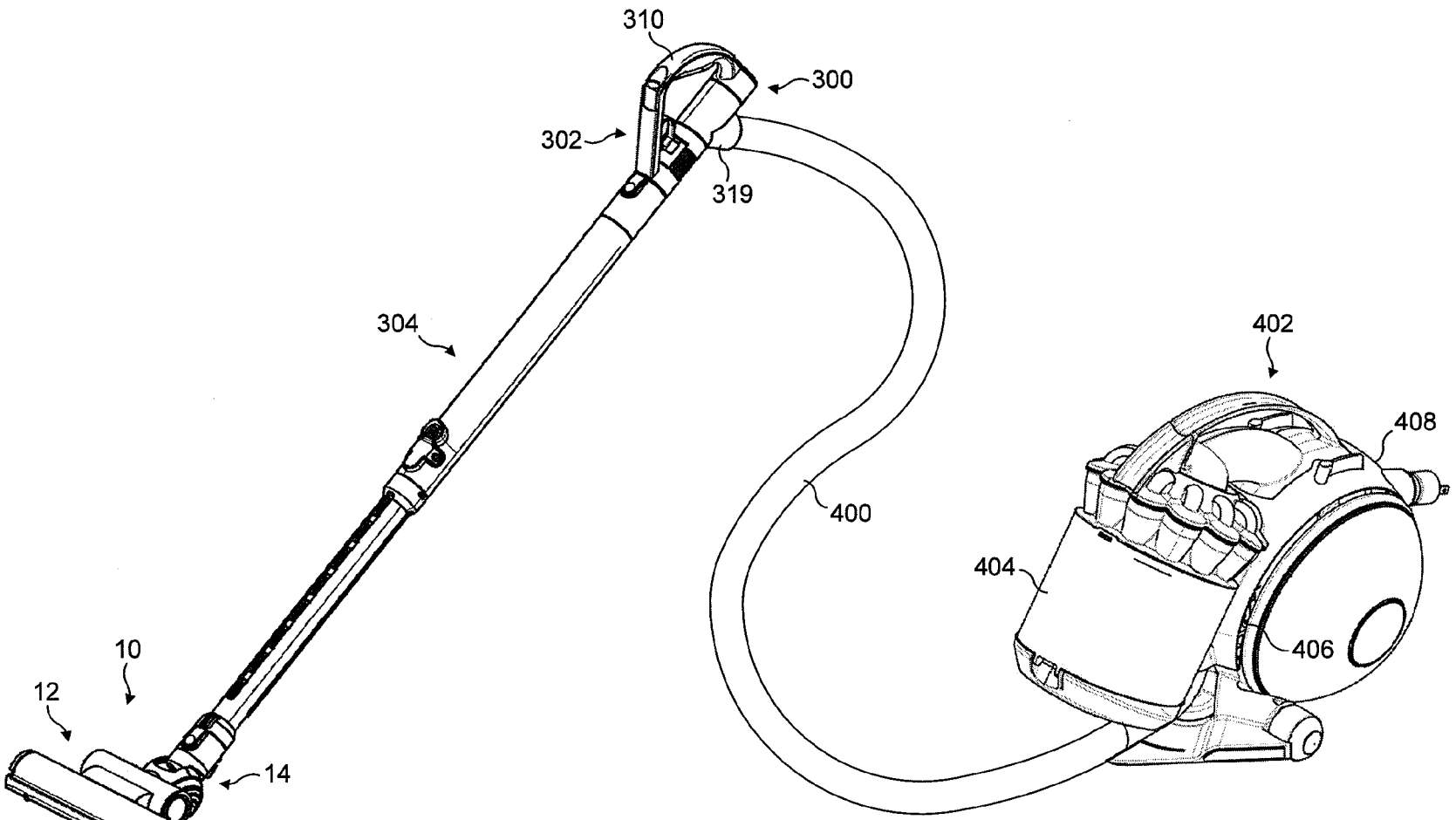
Figure 14A:
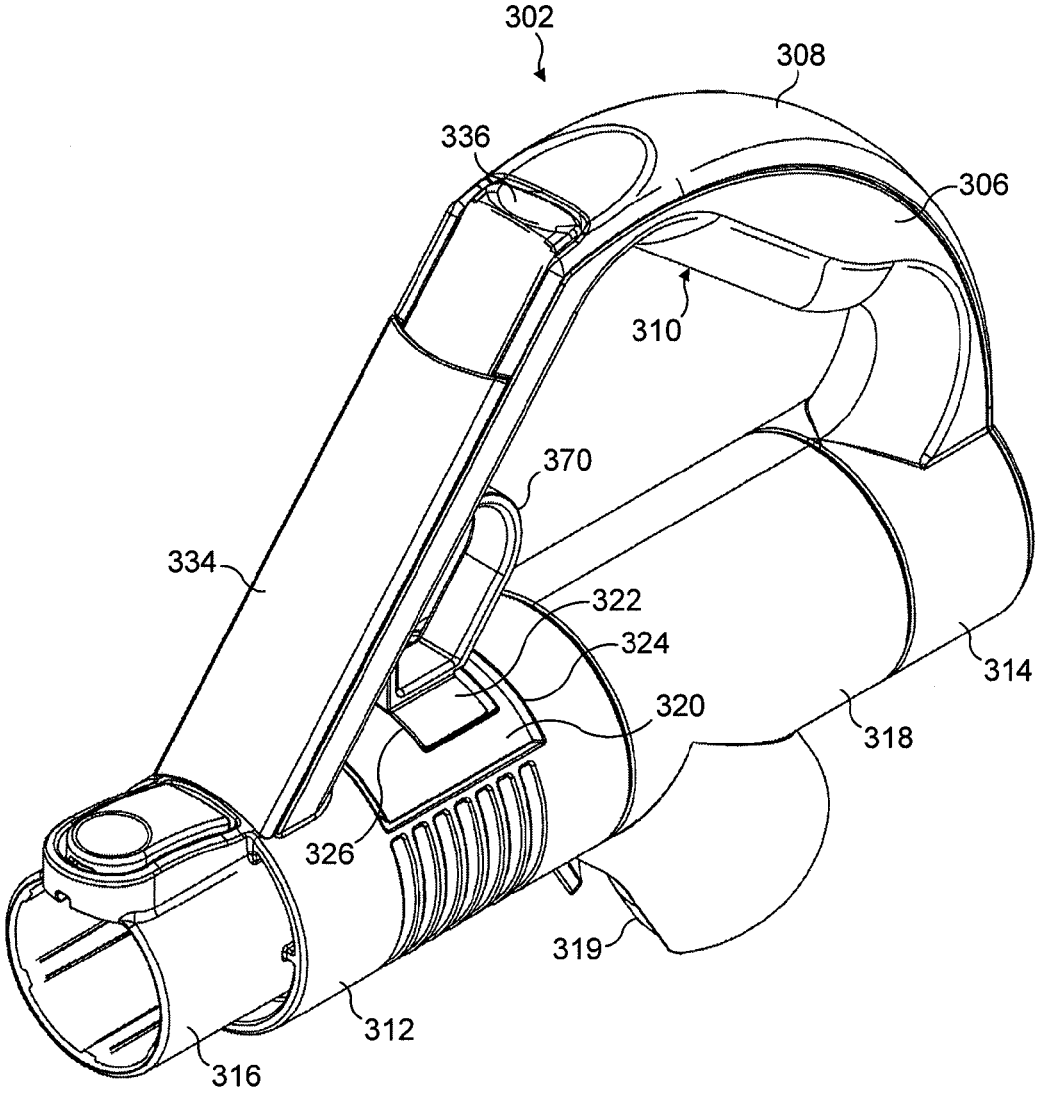
FIG. 14(*a*) is a front left perspective view, from above, of a handle connected to the wand of FIG. 13(*a*)
Figure 14B:
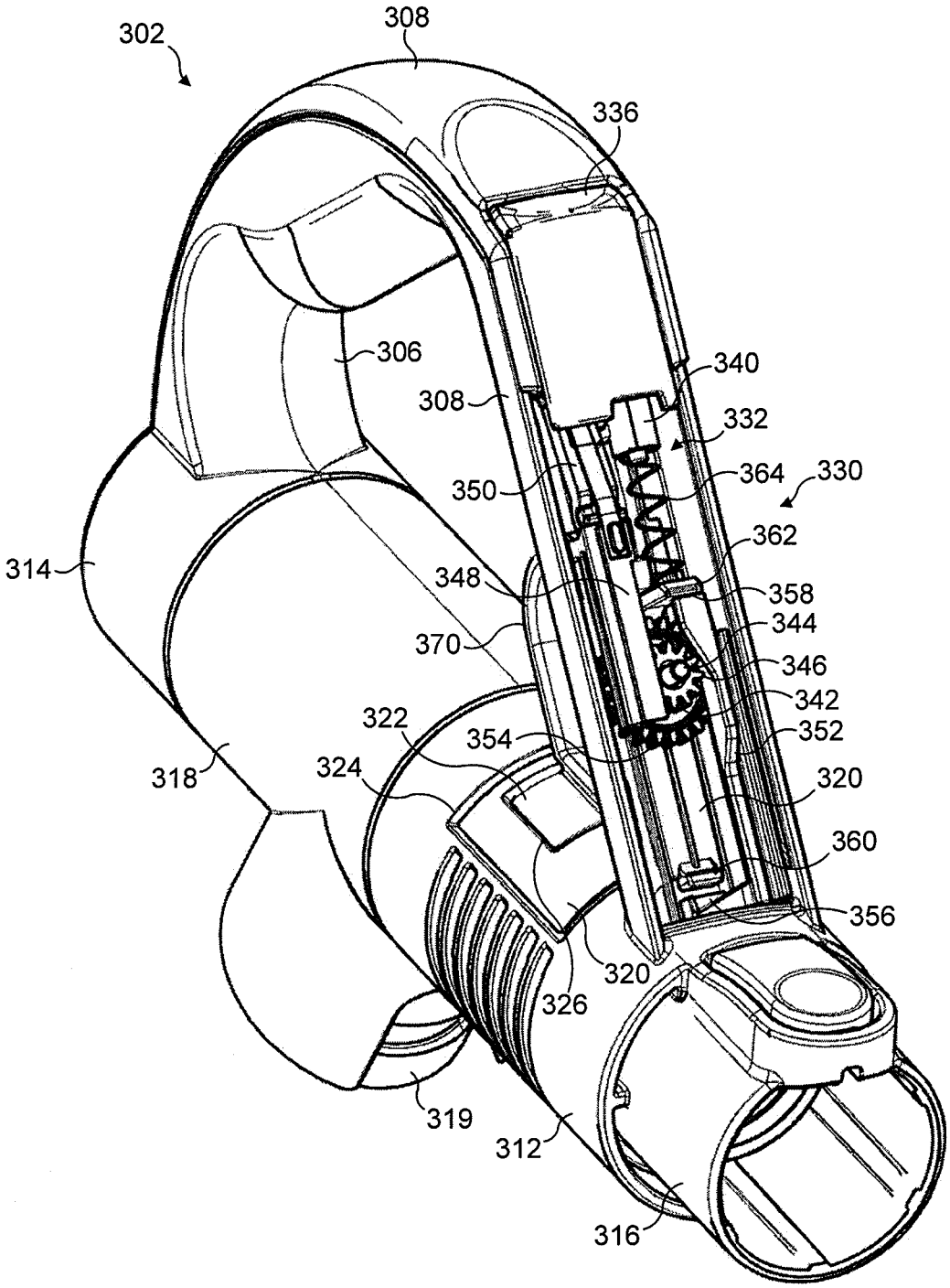
Figure 14C:
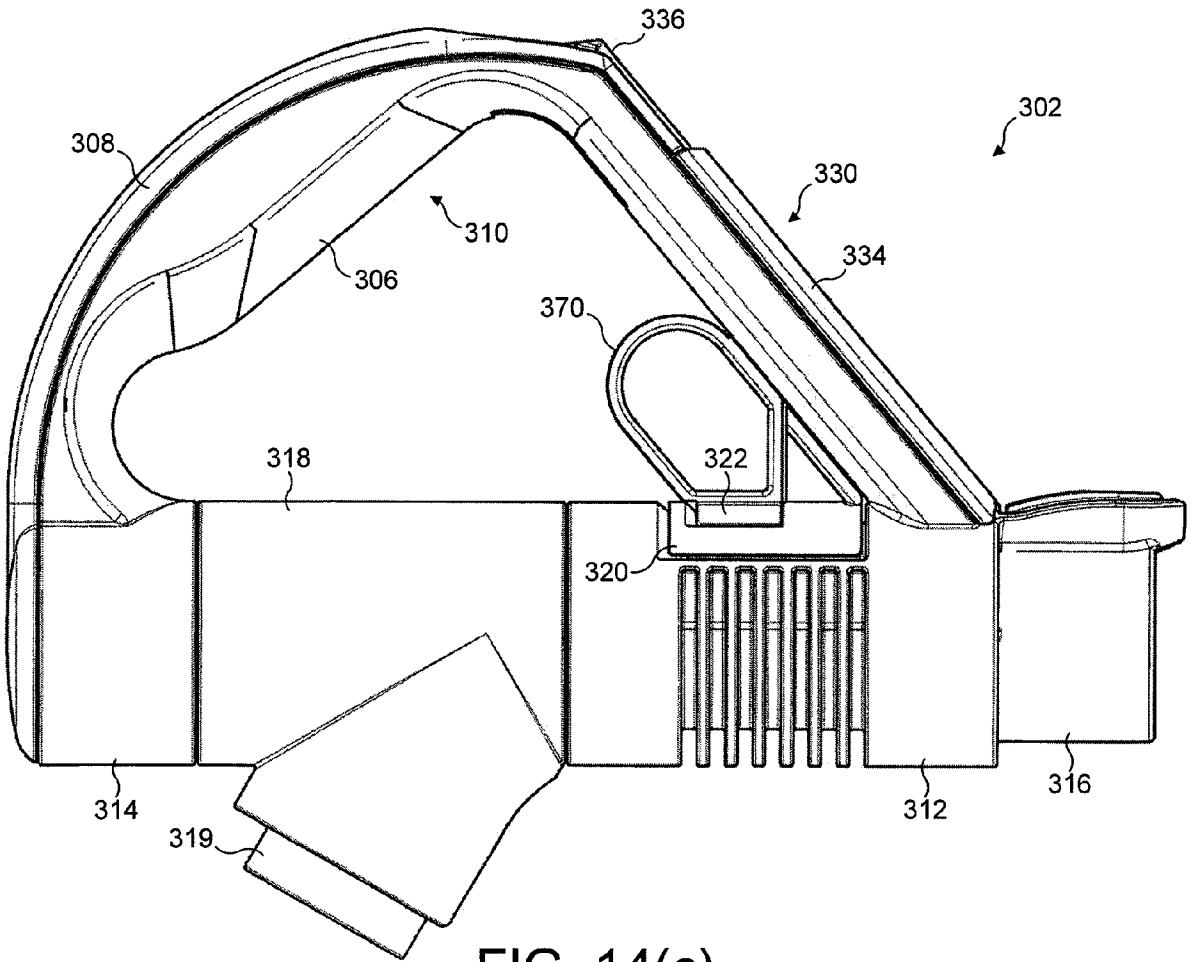
Figure 14D:
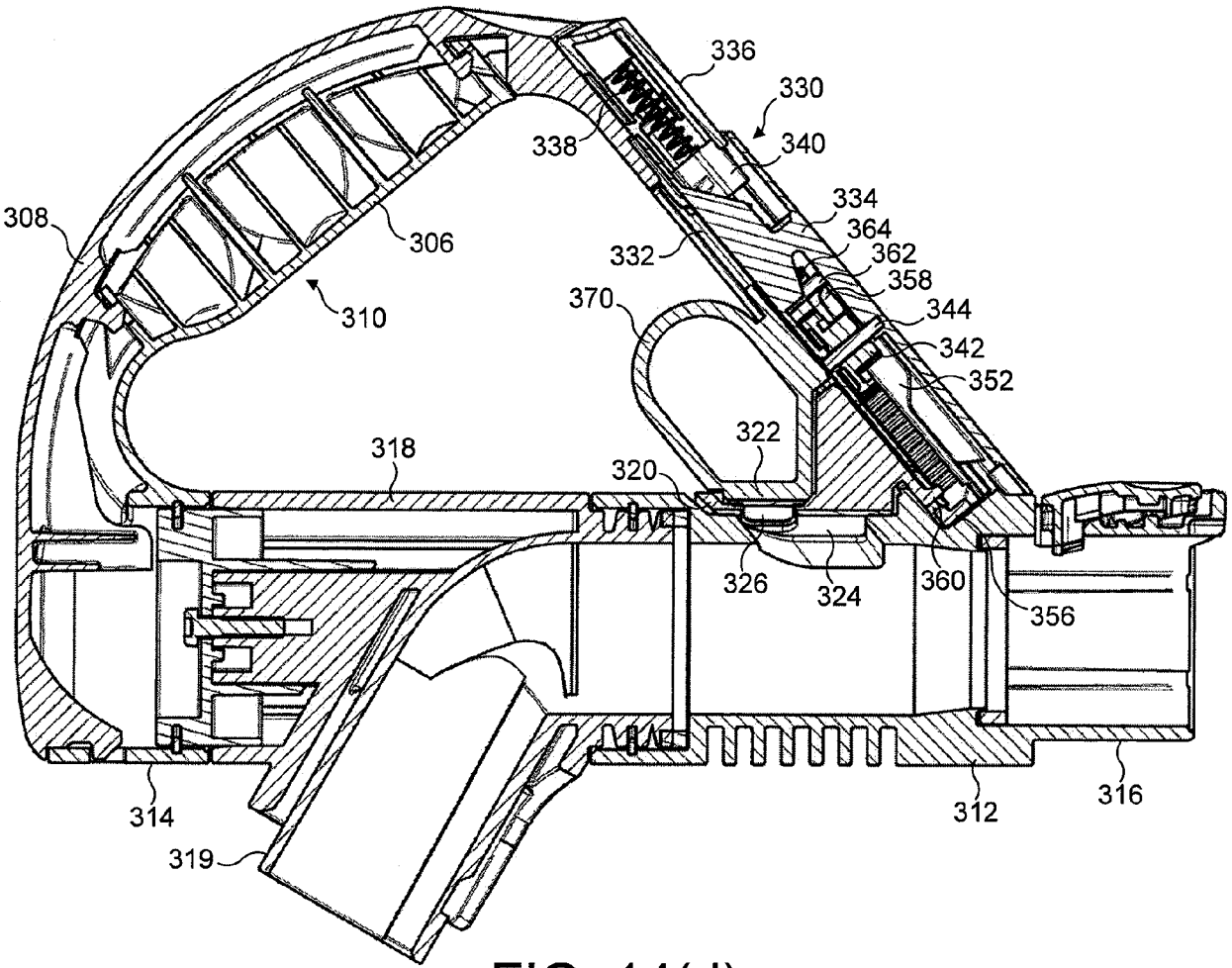

The transition of the agitator 60 from an active, rotating state to an inactive, stationary state is effected by varying temporarily the air pressure within the pressure chamber 176. This is in turn effected by varying temporarily the air pressure within the air duct 82, which is connected to the pressure chamber 176 via the turbine chamber 74 and the conduit 192. The pressure within the air duct 82 is varied by operating a valve assembly 300 to admit air from the external environment into a flow path extending from the outlet section 94 of the conduit 14 of the floor tool 10 to the fan unit of the vacuum cleaning appliance. As illustrated in FIG. 13(*a*), in this embodiment the valve assembly 300 is located on a handle 302 which is connected to a first end of a wand 304. The floor tool 10 is connected to the other end of the wand 304. As illustrated in FIG. 13(*b*) the handle 302 is connected to a hose 400 of a vacuum cleaning appliance 402. The appliance 402 includes a separating apparatus 404, preferably a cyclonic separating apparatus, for removing dirt and dust from the airflow received from the hose 400, and a fan unit 406 (indicated in dashed lines) which is located within a main body 408 of the appliance 402 for drawing the airflow through the appliance 402.

With reference also to FIGS. 14(*a*) to 14(*d*), the handle 302 comprises a handle body 306 and a handle cover 308 which together define a handgrip portion 310 configured to be grasped by a user. The handgrip portion 310 extends between a front tubular section 312 and a rear section 314 of the handle body 306. The front section 312 of the handle 302 is connectable to the first end of the wand 304, and comprises an air inlet 316 for receiving an air flow from the wand 304. The handle 302 further comprises a cylindrical rotatable section 318 which is connected between the front section 312 and the rear section 314 of the handle body 306 for rotation relative thereto. An air outlet 319 of the handle 302 extends outwardly from the side wall of the rotatable section 318 for connection to the hose 400 for conveying the air flow to the separating apparatus 404 of the vacuum cleaning appliance 402.

As discussed in more detail below, the valve assembly 300 comprises a first valve 320 and a second valve 322. The first valve 320 extends about and supports the periphery of the second valve 322. The first valve 320 and the second valve 322 are arranged to occlude a relatively large, first aperture 324 formed in the front section 312 of the handle body 306, preferably beneath the handgrip portion 310 of the handle 302. The second valve 322 is arranged to occlude a relatively small, second aperture 326 formed in the first valve 320. As illustrated in FIG. 14(*d*), this second aperture 326 is located above the first aperture 324, and so the second valve 322 may be considered to occlude a relatively small section of the first aperture 324, while the first valve 320 may be considered to occlude a relatively large section of the first aperture 324. Each of the apertures 324, 326 is thus arranged to admit atmospheric air into an air flow passing through the handle 302.

The valve assembly 300 is operable to move the first valve 320 and the second valve 322 relative to the handle body 306. As discussed below, the first valve 320 and the second valve 322 may be moved simultaneously to expose the first aperture 324, whereas the second valve 322 may be moved separately from the first valve 320 to expose the second aperture 326. In other words, the second valve 322 may be moved relative to the first valve 320 between a closed position, in which the second aperture 326 is occluded, and an open position, in which the second aperture 326, and therefore part of the first aperture 324, is exposed. On the other hand, the first valve 320 is movable simultaneously with the second valve 322 between a closed position, in which the first aperture 324 is occluded, and an open position, in which the first aperture 324 is fully exposed.

Figure 15A:
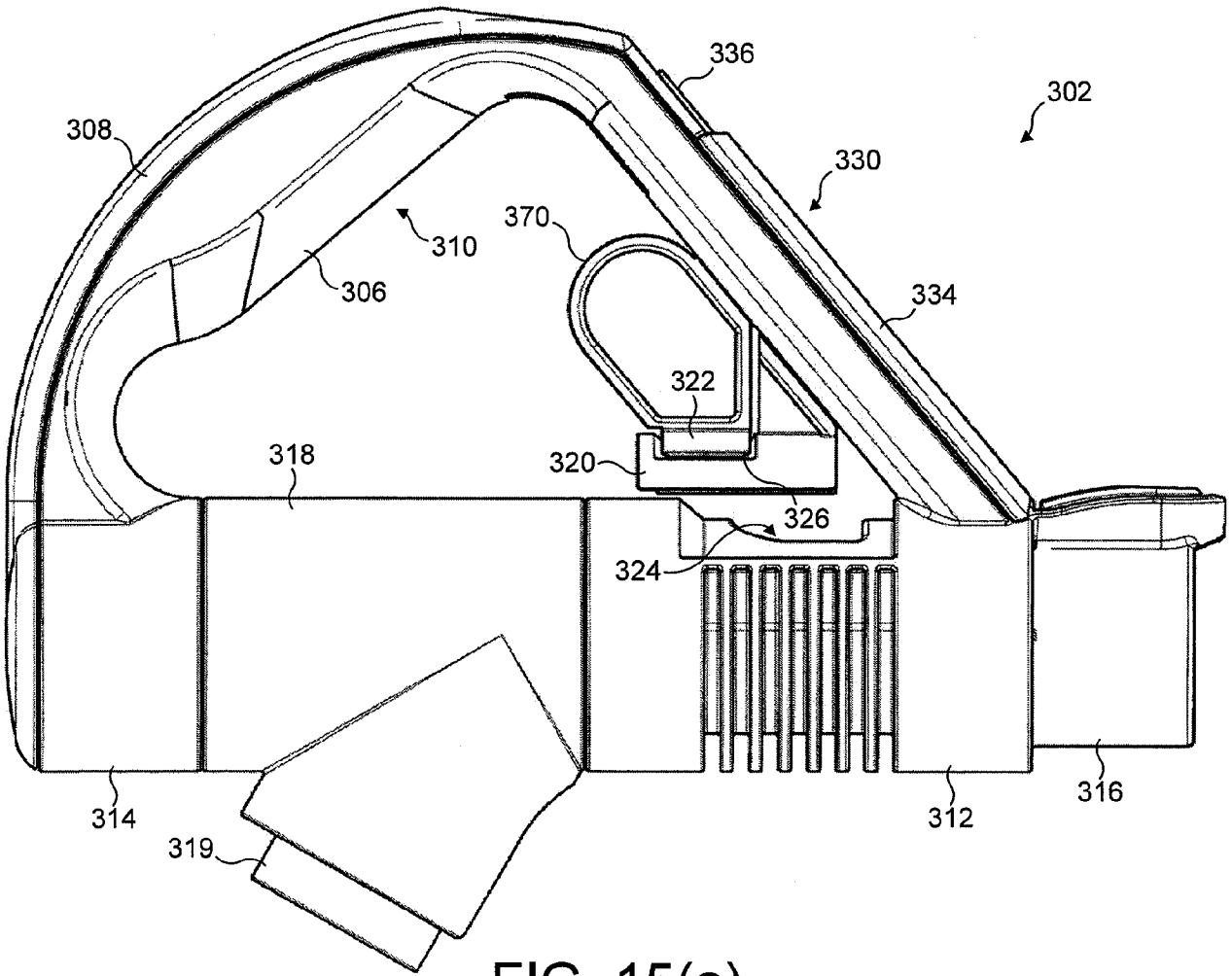
FIG. 15(*a*) is a right side view of the handle, with the valves of the handle in an open position.
Figure 15B:
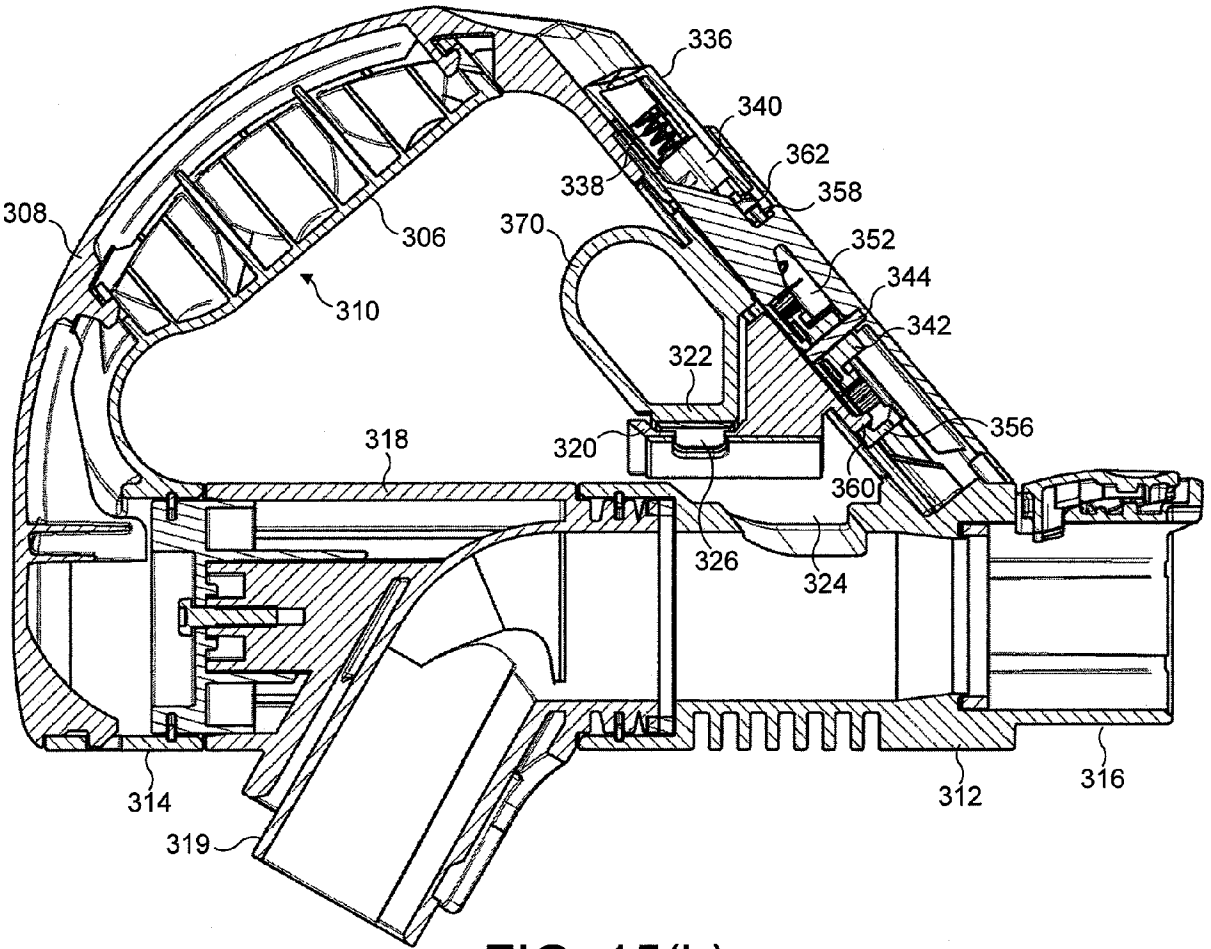

With particular reference now to FIGS. 14(*b*) and 14(*d*), the valve assembly 300 comprises a valve drive mechanism 330 for moving the valves 320, 322 between their closed and open positions. The valve drive mechanism 330 is located within a housing 332 which is located between the handle cover 308 and a valve drive cover 334 which is connectable to the handle cover 308. The valve drive mechanism 330 comprises a first actuator which in the form of a button 336 which protrudes upwardly and outwardly from the housing 332. The button 336 is depressible by the user using the thumb of the hand grasping the handgrip portion 310 of the handle 302 so as to slide relative to the handgrip portion 310 from a raised position, as illustrated in FIGS. 14(*a*) to 14(*d*), to a lowered position, as illustrated in FIGS. 15(*a*) and 15(*b*). The button 336 is biased towards the raised position by a first handle spring 338 which has a first end which engages the button 336 and a second end which engages a spring abutment member 340 connected to, and preferably integral with, the handle cover 308.

The valve drive mechanism 330 further comprises a compound gear 342 which is mounted on a spindle 344 connected to the handle cover 308. A first set of teeth 346 of the compound gear 342 mesh with a set of teeth located on a drive rack 348. A latch 350 extends between the button 336 and the drive rack 348 so that the drive rack 348 moves with the button 336 between its raised and lowered positions. A driven rack 352 is located on the opposite side of the compound gear 342 to the drive rack 348. The driven rack 352 has a set of teeth which mesh with a second set of teeth 354 of the compound gear 342 so that the drive rack 348 and the driven rack 352 move in opposite directions with rotation of the compound gear 342. The driven rack 352 comprises a first valve drive member 356 located at the lower end thereof, and a second valve drive member 358 located at the upper end thereof. The first valve 320 comprises a first valve ridge 360 which is normally spaced from the first valve drive member 356. The second valve 322 comprises a second valve ridge 362 which is urged against the second valve drive member 358 by a second handle spring 364 extending between the spring abutment member 340 and the second valve ridge 362.

To operate the valve assembly 300, the user depresses the button 336 so that the button 336 moves from its raised position towards its lowered position. The movement of the button 336 towards its lowered position causes the drive rack 348 to move downwards towards the front portion 312 of the handle body 306 to rotate the compound gear 342, which results in the driven rack 352 moving upwards away from the front portion 312 of the handle body 306. As the second valve drive member 358 is in contact with the second valve ridge 362, the movement of the driven rack 352 causes the second valve 322 to move upwardly away from the second aperture 326 before the first valve drive member 356 engages the first valve ridge 360. This movement of the second valve 322 before the first valve 320 allows a small amount of ambient air to bleed into the handle 302 through the second aperture 326 prior to the movement of the first valve 320 to expose fully the first aperture 324. The admission of this ambient air into the handle 302 reduces the pressure difference across the first valve 320. This in turn reduces the force that acts on the first valve 320, due to this pressure difference, to urge the first valve 320 against the handle 302, and therefore reduces the force required to move the first valve 320 away from the handle 302 to expose the first aperture 324. With continued rotation of the compound gear 342 as the button 336 moves towards its lowered position, the first valve drive member 356 engages the first valve ridge 360 to raise the first valve 320 simultaneously with the second valve 322 away from the handle 302, as illustrated in FIGS. 15(*a*) and 15(*b*), to expose fully the first aperture 324 to admit ambient air into the airflow passing through the handle 302.

When the valve assembly 300 is operated by the user to expose the first aperture 324, the air pressure within the wand 304 increases, and so the air pressure within the air duct 82 increases. This means that the air pressure within the turbine chamber 74, which is in fluid communication with the air duct 82, also increases, from the first, relatively low sub-atmospheric pressure to a second, relatively high sub-atmospheric pressure. This results in an increase in the pressure of the air within the pressure chamber 176. This in turn results in a decrease in the force acting on the second chamber section 196, due to a reduction in the pressure differential between the air within the pressure chamber 176 and the air outside the pressure chamber 176.

Figure 16A:
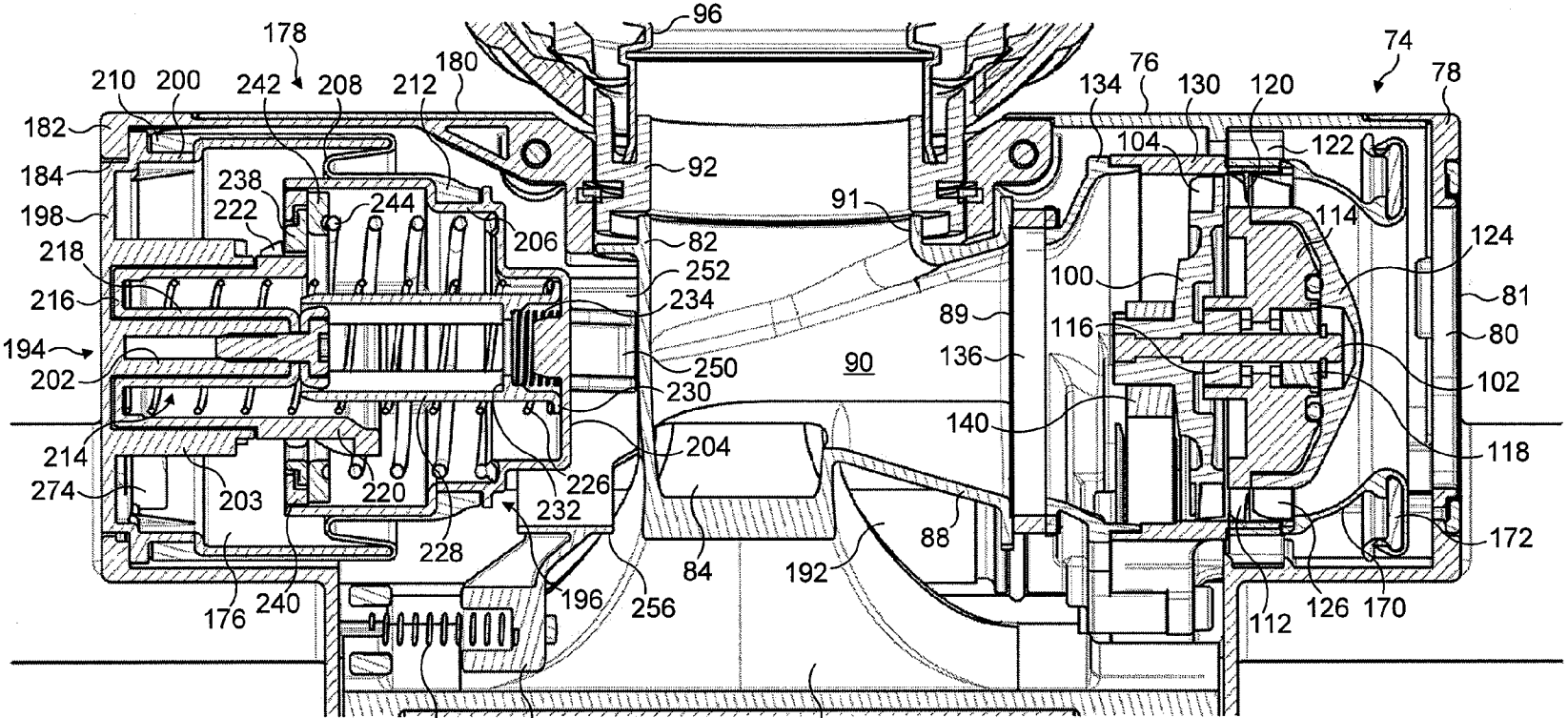
FIG. 16(*a*) is a similar view to FIG. 9(*a*), but with the pressure chamber in a second partially contracted configuration.
Figure 16B:
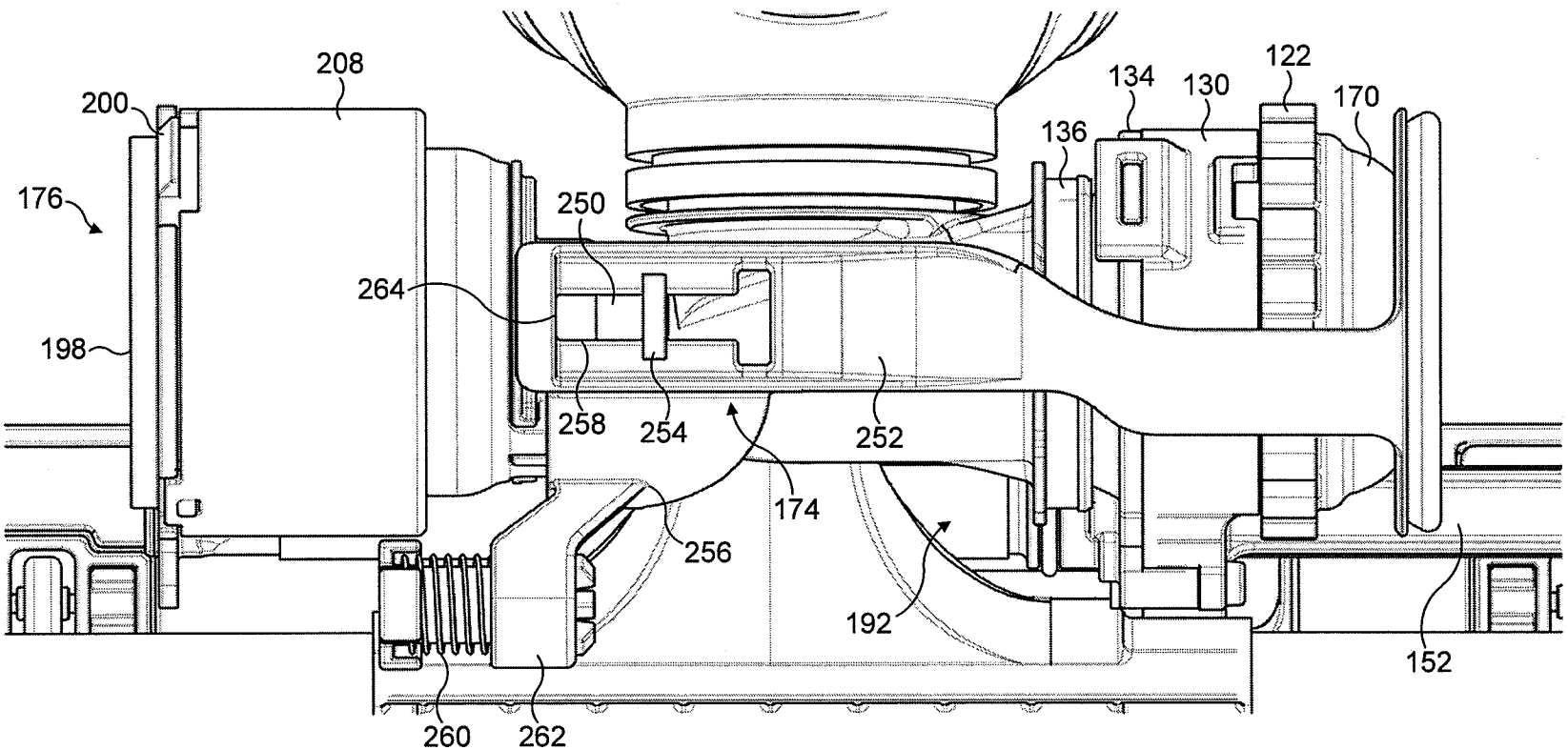

With reference to FIGS. 11(*b*) and 11(*c*), the track 222 of the track carrier 214 is shaped to allow the pins 236 of the track follower 238 to move axially away from the positions P2 back towards the positions P1. The spring constant of the first spring 226 is selected so that the force of the partially compressed spring 226 is greater than the reduced force acting on the second chamber section 196 so that the first spring 226 is able to urge the second chamber section 196 away from the first chamber section 194 towards its expanded configuration. Consequently, and with reference also to FIG. 16(*a*), under the biasing force of the first spring 226 the spring retainer 228 and the second chamber section 196 are moved away from the first chamber section 194 until the annular end of the spring retainer 228 engages the lugs of the retainer clip 235. This prevents further movement of the spring retainer 228 away from the first chamber section 194. On the other hand, the spring constant of the second spring 234 is selected so that the force of the compressed second spring 234 is smaller than the reduced force acting on the second chamber section 196, and so the second spring 234 remains in its compressed configuration with the second chamber section 196 urged against the spring retainer 228. The pressure chamber 176 may be considered to have moved from the first, partially contracted configuration, as shown in FIG. 12(*a*) to a second, partially contracted configuration, as shown in FIG. 16(*a*).

As the pins 236 move away from the positions P2, each pin 236 engages an inclined wall 282 of the track 222, and moves along the wall 282 through rotational and axial movement of the track follower 238 relative to the track carrier 214. When the movement of the track follower 238 relative to the track carrier 214 has stopped, due to the engagement of the end of the spring retainer 228 with the lugs of the retainer clip 235, the pins 236 are in the positions P3 shown in FIG. 11(*c*). As shown in FIG. 16(*b*), the movement of the second chamber section 196 away from the first chamber section 194 does not result in any movement of the second arms 252 relative to the turbine assembly 72, as the end portion 254 of each of the first arms 250 remains spaced from the ends of its respective slot 258. The air path through the turbine chamber 74 remains open, and so the impeller 100 of the turbine assembly 72 continues to rotate to drive the rotation of the agitator 60. However, the control mechanism has now changed to a second state which allows the pressure chamber 176 to move to a fully contracted configuration, as discussed below.

In this embodiment, the valve 320 remains in its open position while the user depresses the button 336. When the button 336 is released by the user, the first handle spring 338 urges the button 336 towards its raised position, while the second handle spring 364 urges the second valve ridge 362 and the driven rack 352 downwardly towards the front portion 312 of the handle body 306. This results in the reverse rotation of the compound gear 342. The downward movement of the driven rack 352 first brings the first valve 320 into contact with the front section 312 of the handle body 306 to occlude partially the first aperture 324, and subsequently brings the second valve 322 into contact with the first valve 320 to occlude the second aperture 326, and thereby occlude fully the first aperture 324. The force of the second handle spring 364 urges the second valve 322 against the first valve 320 to maintain an air-tight seal between the second valve 322 and the first valve 320, and between the first valve 320 and the front section 312 of the handle body 306. The springs 338, 364 are preferably arranged so that the movement of the valves 320, 322 from their open positions to their closed positions takes several seconds so as to allow the second, relatively high sub-atmospheric pressure to be established in the air duct 82 before the apertures 324, 326 are occluded by the valves 320, 322.

With the first aperture 324 occluded by the valves 320, 322, the air pressure within the air duct 82 decreases so that the air pressure within the turbine chamber 74 and the pressure chamber 176 returns to the first, relatively low sub-atmospheric pressure. As a result, the force acting on the second chamber section 196, due to the pressure differential between the air within the pressure chamber 176 and the air outside the pressure chamber 176, increases back to the level prior to the operation of the valve assembly 300. As mentioned above, the spring constant of the first spring 226 is selected so that the force of the partially compressed first spring 226 is lower than the increased force acting on the second chamber section 196. Therefore, with reference to FIG. 17(*a*), under the action of the force acting on the second chamber section 196 the spring retainer 228 and the second chamber section 196 are urged towards the first chamber section 194 against the biasing force of the first spring 226.

With reference also to FIGS. 11(*c*) and 11(*d*), the track 222 of the track carrier 214 is shaped to allow the pins 236 of the track follower 238 to move axially away from the positions P3. Under the action of the increased force applied to the second chamber section 196, as the pins 236 move away from the positions P3 each pin 236 engages an inclined wall 284 of the track 222, and moves along the wall 284, through rotational and axial movement of the track follower 238 relative to the track carrier 214, as the second chamber section 196 is pushed towards the first chamber section 194. At the end of the wall 284, each pin 236 enters an axially extending slot 286 of the track 222 which allows the pins 236 to move rapidly along the track carrier 214.

Figure 17A:
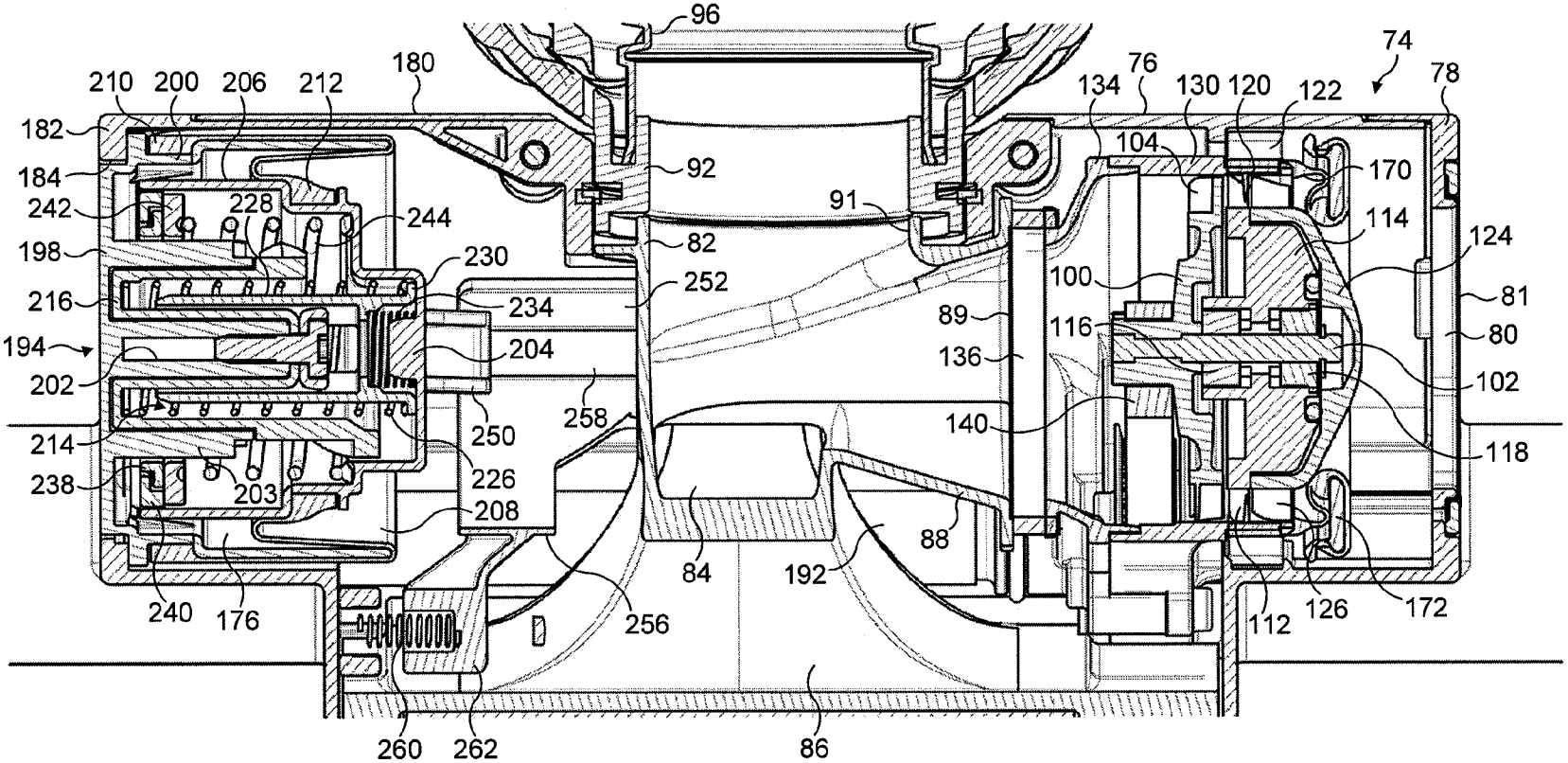
FIG. 17(*a*) is a similar view to FIG. 9(*a*), but with the pressure chamber of the floor tool in a first, fully contracted configuration.
Figure 17B:
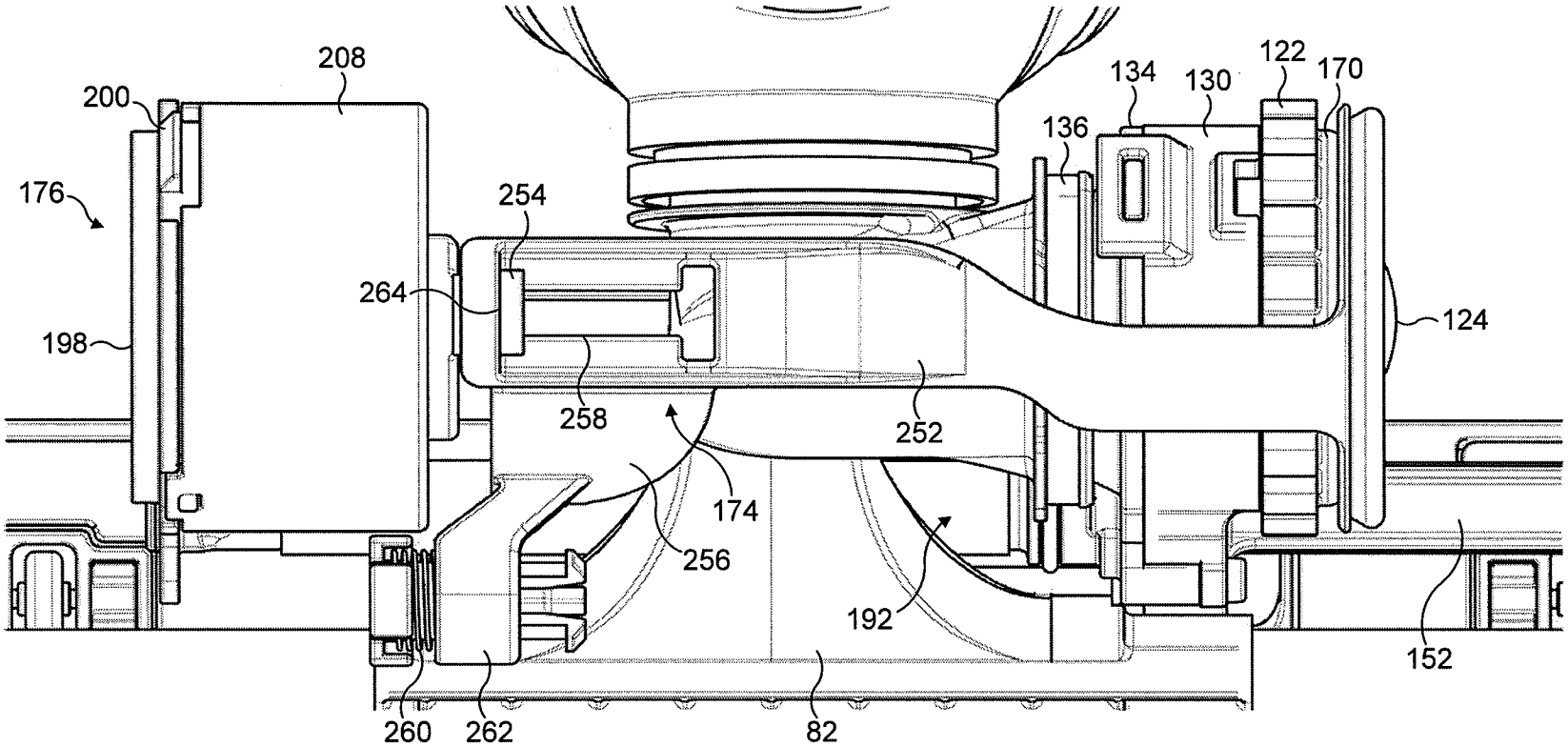

With the movement of the second chamber section 196 towards the first chamber section 194, the end portions of the first arms 250 move along the slots 258 so as to each engage the end 264 of its respective slot 258. The spring constant of the fourth spring 260 is selected so that the force of the fourth spring 260 is lower than the increased force acting on the second chamber section 196. Therefore, with reference to FIGS. 17(*a*) and 17(*b*), under the action of the force acting on the second chamber section 196 the fourth spring 260 is compressed to allow the second arms 252 to be pulled towards the pressure chamber 176 by the first arms 250 of the second chamber section 196 as the second chamber section 196 continues to be pushed towards the first chamber section 194. The movement of the second arms 252 towards the pressure chamber 176 causes the annular member 172 of the control assembly 174 to move towards the turbine assembly 72 until the inner surface of the seal 170 engages the outer surface of the nose cone 124, as shown in FIG. 17(*a*). The contact of the inner surface of the seal 170 with the outer surface of the nose cone 124 prevents further movement of the second chamber section 196 towards the first chamber section 194. The pressure chamber 176 may therefore be considered to be in a fully contracted configuration when the inner surface of the seal 170 engages the outer surface of the nose cone 124. When the pressure chamber 176 is in this fully contracted configuration, the first spring 226, the second spring 234 and the fourth spring 260 are all in fully compressed configurations, and the pins 236 of the track follower 238 are in the positions P4 illustrated in FIG. 11(*d*), in which each pin 236 is located towards the end of a respective slot 286 of the track 222. The third spring 244 remains in an expanded configuration.

The engagement between the inner surface of the seal 170 and the outer surface of the nose cone 124 closes the annular channel between the stator body 114 and the stator housing 120, thereby inhibiting air flow through the turbine chamber 74. The lack of an air flow through the turbine chamber 74 removes the driving force applied to the impeller blades 104, and so the rotational speed of the impeller 100, and therefore that of the agitator 60, decreases gradually to zero. The pressure differential across the seal 170 generates a force which urges the seal 170 against the nose cone 124, against the internal bias of the seal 170, to prevent air flow through the turbine chamber 74.

To re-start the rotation of the agitator 60 relative to the main body 12, the user operates the valve assembly 300 to admit air from the external environment into the flow path. The admission of air into the flow path increases the air pressure within the air duct 82, which in turn increases the air pressure within the turbine chamber 74 and the pressure chamber 176 which are both connected to the air duct 82. The increase in the air pressure within the turbine chamber 74 reduces the force acting on the seal 170 due to the pressure differential across the seal 170, whereas the increase in the air pressure within the pressure chamber 176 reduces the force urging the second chamber section 196 towards the outer chamber 194, which in turn reduces the force which is applied to the seal 170 by the control assembly 174. The reduction in the forces acting on the seal 170 enables the fourth spring 260 to return the seal 170 rapidly to its expanded configuration in which the inner surface of the seal 170 is spaced from the nose cone 124. This allows an air flow to pass through the turbine chamber 74 towards the air duct 82 to drive the rotation of the impeller 100 within the turbine chamber 74, and thus drive the rotation of the agitator 60 within the main body 12.

The return of the seal 170 to its expanded configuration is not inhibited by the control assembly 174. The movement of the fourth spring 260 to its expanded configuration causes the second arms 252 to pull the first arms 250 towards the turbine assembly 72, which in turn causes the first arms 250 to pull the second chamber section 196 away from the first chamber section 194 against the reduced force acting on the second chamber section 196 due to the pressure differential between the air within the pressure chamber 176 and the air outside the pressure chamber 176. As the pins 236 are located towards the ends of the slots 286 of the track 222, the pins 236 are free to move unimpeded along the slots 286 away from the positions P4.

With air flowing through the turbine chamber 74, the pressure within the turbine chamber 74 returns to the second, relatively high sub-atmospheric pressure. As discussed above, the reduction in the force acting on the second chamber section 196 allows the force of the first spring 226 to return the pressure chamber 176 to its second, partially contracted configuration, as shown in FIG. 16(*a*), in which the annular end of the spring retainer 228 engages the lugs of the retainer clip 235. With reference to FIGS. 11(*d*) and 11(*e*), as the pressure chamber 176 is returned to this configuration each pin 236 of the track follower 238 moves axially along a respective slot 286 until the pin 236 engages a respective inclined wall 288 of the track 222. Through a combination of axial and rotational movement of the track follower 238 relative to the track carrier 214, the pins 236 move along the walls 288. At the end of the wall 288, each pin 236 enters an axially extending slot 290 of the track 222 which allows the pins 236 to move along the track 222 to the positions P5. The pins 236 do not move beyond the positions P5 due to the engagement of the lugs of the retainer clip 235 with the end of the spring retainer 228. The positions P5 are spaced circumferentially from the positions P3, and are each located in a path, extending between a position P1 and a position P2, along which one of the pins 236 moved when the vacuum cleaning appliance was first switched on. The control mechanism may be considered to have returned to its first state which prevents the pressure chamber 176 from moving to its fully contracted configuration. However, each pin 236 is now located within a different track section from that in which that pin 236 was located when the appliance was first switched on.

As discussed above, when the button 336 is released by the user the valves 320, 322 move to occlude the apertures 324, 326 so that the air pressure within the air duct 82 returns to the first, relatively low sub-atmospheric pressure. As a result, the force acting on the second chamber section 196, due to the pressure differential between the air within the pressure chamber 176 and the air outside the pressure chamber 176, increases back to the level prior to the operation of the valve assembly 300. As mentioned above, the spring constant of the first spring 226 is selected so that the force of the partially compressed first spring 226 is lower than the increased force acting on the second chamber section 196. Therefore, under the action of the force acting on the second chamber section 196 the spring retainer 228 and the second chamber section 196 are urged towards the first chamber section 194 against the biasing force of the first spring 226 so that the pins 236 move to the positions P2 illustrated in FIG. 11(*b*) and the pressure chamber 176 returns to its first, partially contracted configuration illustrated in FIG. 12(*a*). The seal 170 is maintained in its expanded configuration, and so the air flow is maintained through the turbine chamber 74.

Thus, the agitator 60 may be easily toggled between an active, rotating state and an inactive, stationary state as required by the user through simply operating the valve assembly 300.

During use, the second valve 322 may be moved to an open position in isolation from the first valve 320. This can enable the pressure at the suction opening 36 to be increased to a level which enables the floor tool 10 to be used to clean curtains or other loose fabric without that fabric becoming trapped within the main body 12 of the floor tool. To open the second valve 322, the user operates a second actuator to move the second valve 322 away from the second aperture 326. In this embodiment, the second actuator is in the form of a trigger 370 located beneath the handgrip portion 310 of the handle 302, and which is attached to the second valve 322. The trigger 370 may be pulled by the user using a finger of the hand which is grasping the handle 302 to move the second valve 322 away from the second aperture 326 against the biasing force of the second handle spring 364. Due to the support of the periphery of the second valve 322 by the first valve 320, pulling the second valve 322 away from the second aperture 326 does not cause the first valve 320 to move away from the first aperture 324. For example, the first valve 320 may be provided with inclined support surfaces for supporting the second valve 322, and which allow the second valve 322 to move away from the first valve 320 without dragging the first valve 320 away from the first aperture 324.

When the cleaning of the fabric has been completed, the user releases the trigger 370 to allow the second handle spring 364 to return the second valve 322 automatically to its closed position. As the second aperture 326 is smaller than the first aperture 324, the exposure of only the second aperture 326 to the atmosphere is insufficient to raise the pressure within the turbine chamber 74 to the second, relatively high sub-atmospheric pressure and thus actuate a change in the state of the agitator 60.

When the user switches off the vacuum cleaning appliance, the pressure in the air duct 82, and therefore the air pressure within the pressure chamber 176, returns to atmospheric pressure, thereby removing the force which otherwise urges the second chamber section 196 towards the first chamber section 194. Under the biasing force of the springs 226, 234 the pressure chamber 176 is urged towards its expanded configuration. If the agitator 60 is rotating when the vacuum cleaning appliance is switched off, the pins 236 move, with both axial and rotational movement of the track follower 238 relative to the track carrier 214, from positions P2 to positions P3 under the biasing force of the first spring 226, and then from the positions P3 to the positions P1 under the biasing force of the second spring 234. The position P1 to which each pin 236 returns is not necessarily the same position P1 as that pin 236 was in when the appliance was first switched on, as this depends on the number of times that the agitator 60 has been placed in an inactive state during use of the appliance.

If, on the other hand, the agitator 60 is stationary when the vacuum cleaning appliance is switched off, the pins 236 move, again with both axial and rotational movement of the track follower 238 relative to the track carrier 214, from positions P4 to positions P5 under the biasing force of the first spring 226, and then from the positions P5 to the positions P1 under the biasing force of the second spring 234. Again, the position P1 to which each pin 236 returns is not necessarily the same position P1 as that pin 236 was in when the appliance was first switched on.

The return of the pins 236 of the track follower 238 to the positions P1 maintains the control mechanism in its first state. Consequently, when the vacuum cleaning appliance is switched off the control assembly 174 will adopt a configuration in which an air flow is drawn through the turbine chamber 74 to rotate the agitator 60 when the appliance is next switched on, irrespective of the state of the agitator 60 when the appliance was switched off.

During operation of the vacuum cleaning appliance, and while the agitator 60 is in an active state, the control assembly 174 is in the configuration illustrated in FIGS. 12(*a*) and 12(*b*), and the pressure chamber 176 is in the first, partially contracted configuration. Rotation of the fan unit of the appliance causes a first air flow to be drawn into the main body 12 of the floor tool 10 through the suction opening 36, and a second air flow to be drawn into the turbine chamber 74 through the air inlet 80. The first air flow passes through the main body 12 to the air outlet 86 of the main body 12, and enters the air duct 82 from the air inlet 84. The second air flow passes through the turbine chamber 74 and enters the air duct 82 from the side inlet 88.

In the event that the airflow path through the main body 12 becomes blocked in some way, such as by an object becoming trapped in the ducting or by the suction opening 36 becoming sealed against a surface, an increased amount of air will flow through the turbine chamber 74. This increase in airflow will increase the speed of rotation of the impeller 100, and in turn increase the speed of rotation of the agitator 60. In such a circumstance, the control assembly 174 operates in response to the increased airflow through the turbine chamber 74 to inhibit rotation of the impeller 100 and so prevent damage to components of the drive mechanism 70, for example the bearings 116, 118 or the belts 142, 158, due to the increased rotational speed of the impeller 100.

Figure 18A:
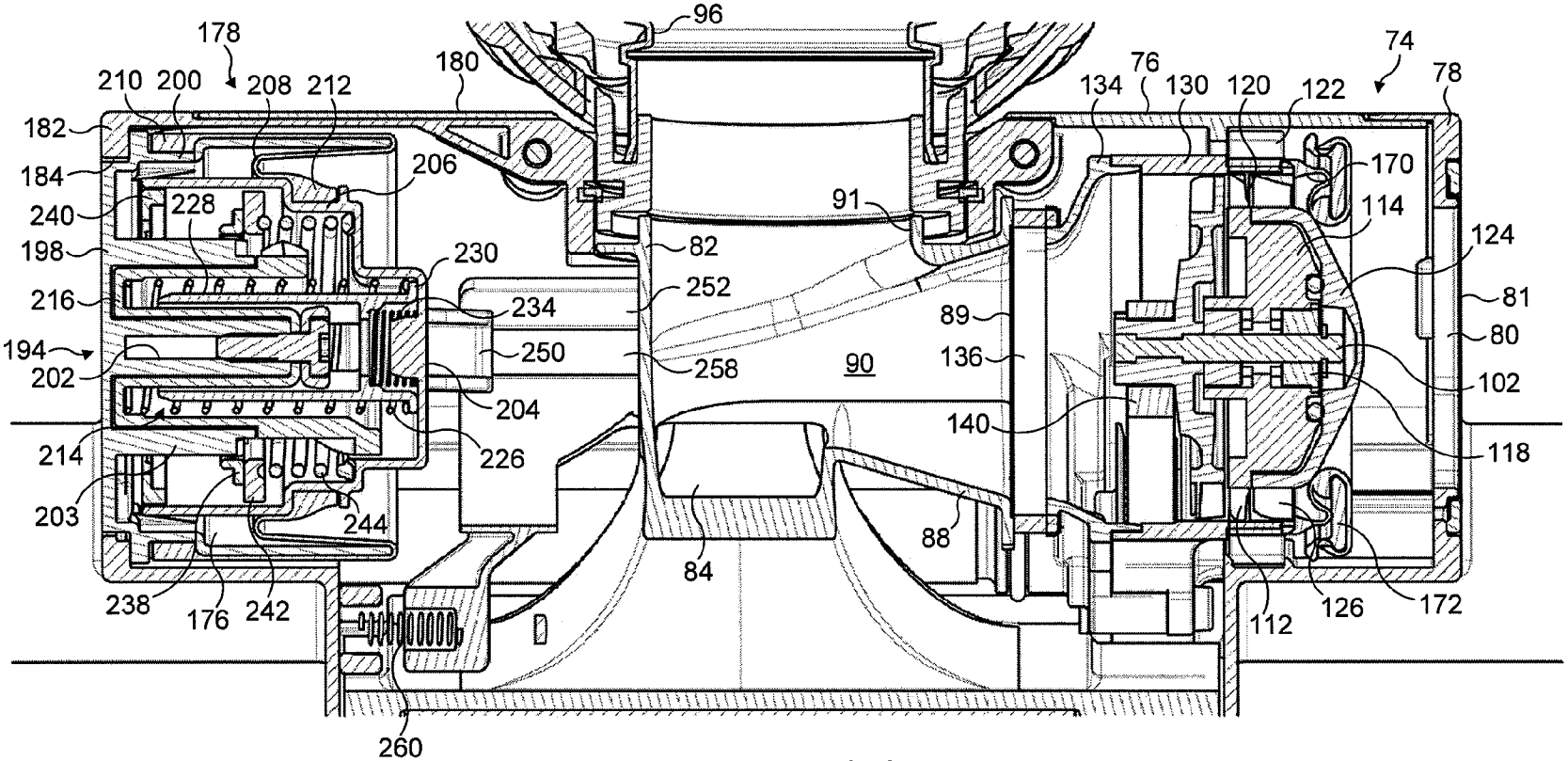
FIG. 18(*a*) is a similar view to FIG. 9(*a*), but with the pressure chamber of the floor tool in a second, fully contracted configuration.
Figure 18B:
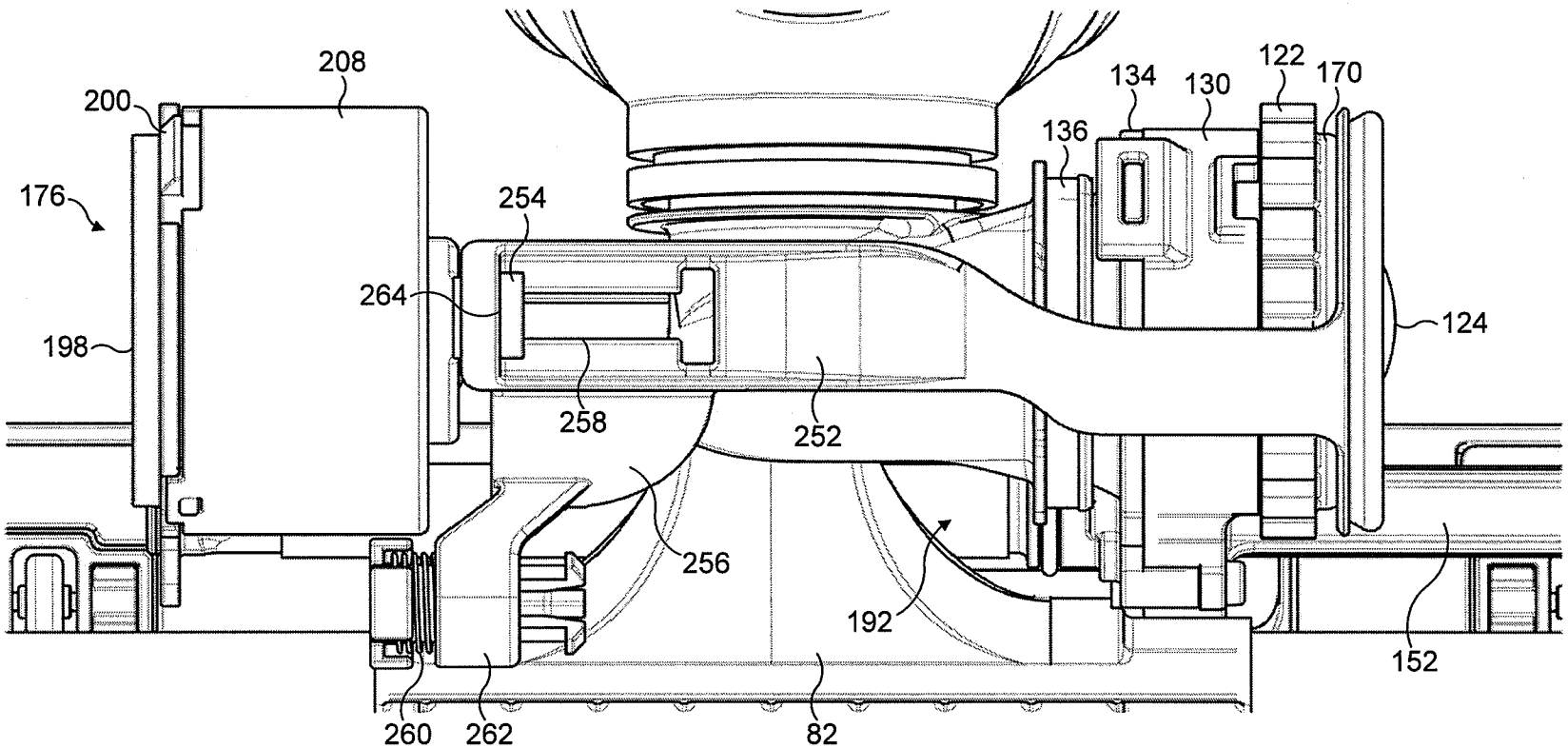

The increased airflow through the turbine chamber 74 reduces the air pressure within the turbine chamber to a third sub-atmospheric pressure which is lower than the first, relatively low sub-atmospheric pressure. The reduction in the air pressure within the turbine chamber 74 reduces the air pressure within the pressure chamber 176, which increases the pressure difference between the air within the pressure chamber 176 and the air outside the pressure chamber 176. This in turn increases the force urging the second chamber section 196 towards the first chamber section 194. This increased force acting on the second chamber section 196 causes the second chamber section 196 to move towards the first chamber section 194, against the biasing force of the third spring 244, as illustrated in FIG. 18(*a*). Due to the location of the pins 236 of the track follower 238 in the positions P2, the track follower 238 and the annular disc 242 remain in a fixed position relative to the track 222, but the retaining ring 240, which is connected to the second chamber section 196, moves away from the track follower 238 as the second chamber section 196 moves towards the first chamber section 194. FIG. 18(*a*) illustrates the pressure chamber 176 in a second, fully contracted configuration. As discussed above in connection with FIGS. 17(*a*) and 17(*b*), the second arms 252 are pulled towards the pressure chamber 176 by the first arms 250 of the second chamber section 196 as the second chamber section 196 is urged towards the first chamber section 194. The movement of the second arms 252 towards the pressure chamber 176 causes the annular member 172 of the control assembly 174 to move towards the turbine assembly 72 until the inner surface of the seal 170 engages the outer surface of the nose cone 124, as shown in FIG. 18(*a*). The engagement between the inner surface of the seal 170 and the outer surface of the nose cone 124 closes the annular channel between the stator body 114 and the stator housing 120, thereby inhibiting air flow through the turbine chamber 74. The lack of an air flow through the turbine chamber 74 removes the driving force applied to the impeller blades 104, and so the rotational speed of the impeller 100, and therefore that of the agitator 60, decreases gradually to zero.

When the agitator 60 has stopped rotating, the user may switch off the vacuum cleaning appliance to allow the blockage to be removed. When the appliance is switched off, the pressure in the air duct 82, and therefore the air pressure within the pressure chamber 176, returns to atmospheric pressure, thereby removing the force which otherwise urges the second chamber section 196 towards the first chamber section 194. Under the biasing force of the springs 226, 234, 244, 260, the pressure chamber 176 is urged towards its expanded configuration. The pins 236 move, with both axial and rotational movement of the track follower 238 relative to the track carrier 214, from positions P2 to positions P3 under the biasing force of the first spring 226, and then from the positions P3 to the positions P1 under the biasing force of the second spring 234. The return of the pins 236 of the track follower 238 to the positions P1 returns the control mechanism to its first state so that an air flow is drawn through the turbine chamber 74 to rotate the agitator 60 when the appliance is next switched on.

The invention claimed is:

1. A vacuum cleaning appliance comprising:

a vacuum cleaning head having a suction opening, the head having a first state and a second state;

a fan unit for drawing an air flow through the suction opening; and a control assembly for controlling the state of the head, the control assembly comprising:

a user-operable valve for increasing temporarily an air pressure within an airflow path extending from the suction opening to the fan unit;

a pressure chamber having an interior volume in fluid communication with the airflow path, the pressure chamber being moveable from an expanded configuration to a contracted configuration in response to a pressure difference between the interior volume and ambient air, the pressure chamber being biased towards the expanded configuration; and a control mechanism for allowing the pressure chamber to move to the contracted configuration in response to a first operation of the valve to place the head in one of the first and second states, and for preventing the pressure chamber from returning to the contracted configuration in response to a second operation of the valve to place the head in the other of the first and second states.

2. The vacuum cleaning appliance of claim 1, wherein the head comprises an agitator for agitating a surface, and wherein the agitator is active when the head is in the first state and inactive when the head is in the second state.

3. The vacuum cleaning appliance of claim 2, wherein the agitator is raised above the suction opening when the head is in the first state.

4. The vacuum cleaning appliance of claim 2, wherein the agitator is rotatable relative to the suction opening when the head is in the first state.

5. The vacuum cleaning appliance of claim 4, comprising a drive mechanism for rotating the agitator relative to the housing, and wherein the control assembly is arranged to deactivate the drive mechanism in response to the first operation of the valve and to re-activate the drive mechanism in response to the second operation of the valve.

6. The vacuum cleaning appliance of claim 5, wherein the drive mechanism comprises an air turbine assembly comprising an impeller for driving the agitator.

7. The vacuum cleaning appliance of claim 6, comprising a turbine air inlet, separate from the suction opening, for admitting a second air flow to the turbine assembly.

8. The vacuum cleaning appliance of claim 7, wherein the control assembly comprises a closure member for substantially closing the turbine air inlet, the closure member being moveable between an open position and a closed position in response to operation of the valve.

9. The vacuum cleaning appliance of claim 8, wherein the closure member comprises a seal for sealing the turbine air inlet when the closure member is in the closed position.

10. The vacuum cleaning appliance of claim 9, wherein the closure member is biased to urge the closure member towards the open position.

11. The vacuum cleaning appliance of claim 7, wherein the pressure chamber is connected to the airflow path via a turbine chamber housing the turbine assembly.

12. The vacuum cleaning appliance of claim 1, wherein the control mechanism has a first state for preventing the pressure chamber from adopting the contracted configuration, and a second state for allowing the pressure chamber to adopt the contracted configuration, the control mechanism being arranged to change between the first and second states in response to an increase in the interior volume of the pressure chamber.

13. The vacuum cleaning appliance of claim 12, wherein the control mechanism is arranged to adopt the first state when there is substantially no pressure difference between the interior volume and the ambient air.

14. The vacuum cleaning appliance of claim 1, wherein the pressure chamber comprises a first chamber section and a second chamber section which is moveable relative to the first chamber section.

15. The vacuum cleaning appliance of claim 14, wherein the pressure chamber comprises an intermediary member located between the first and second chamber sections, a first spring for biasing the intermediary member away from the first chamber section, and a second spring for biasing the second chamber section away from the intermediary member.

16. The vacuum cleaning appliance of claim 15, wherein the first spring has a higher spring constant than the second spring.

17. The vacuum cleaning appliance of claim 16, wherein the second spring is configured to remain in a compressed configuration when the head changes between the first and second states.

18. The vacuum cleaning appliance of claim 14, wherein the control mechanism comprises a track carrier connected to the first chamber section, and a track follower connected to the second chamber section for movement relative to the track carrier, the track carrier comprising a track for guiding movement of the track follower relative to the track carrier as the pressure chamber moves between the expanded and contracted configurations.

19. The vacuum cleaning appliance of claim 18, wherein the track follower is rotatable relative to the track carrier.

20. The vacuum cleaning appliance of claim 19, wherein the track follower is rotatable relative to the second chamber section.

21. The vacuum cleaning appliance of claim 1, wherein the valve is arranged to admit air into a portion of the airflow path located between the head and the fan unit.

* * * * *